US010841707B2

(12) United States Patent
Johnson

(10) Patent No.: US 10,841,707 B2
(45) **Date of Patent: *Nov. 17, 2020**

(54) PRECISION AUDIO SPEAKER COIL ASSEMBLY AND METHOD FOR MAKING SAME

(71) Applicant: Corydon M. Johnson, Anthem, AZ (US)

(72) Inventor: Corydon M. Johnson, Anthem, AZ (US)

( * ) Notice: Subject to any disclaimer, the term of this patent is extended or adjusted under 35 U.S.C. 154(b) by 3 days.

This patent is subject to a terminal disclaimer.

(21) Appl. No.: 16/284,997

(22) Filed: Feb. 25, 2019

(65) Prior Publication Data

US 2019/0289400 A1 Sep. 19, 2019

Related U.S. Application Data

(63) Continuation of application No. 15/893,223, filed on Feb. 9, 2018, now Pat. No. 10,244,327.

(60) Provisional application No. 62/457,003, filed on Feb. 9, 2017.

(51) Int. Cl.

| | |
|---|---|
| ***H04R 9/06*** | (2006.01) |
| ***H04R 3/04*** | (2006.01) |
| ***H04R 7/02*** | (2006.01) |
| ***H04R 7/04*** | (2006.01) |
| ***H04R 9/04*** | (2006.01) |
| ***H04R 31/00*** | (2006.01) |
| *H04R 1/40* | (2006.01) |

(52) U.S. Cl.

CPC ..... *H04R 9/06* (2013.01); *H04R 3/04* (2013.01); *H04R 7/02* (2013.01); *H04R 7/04* (2013.01); *H04R 9/047* (2013.01); *H04R 31/00* (2013.01); *H04R 1/403* (2013.01)

(58) Field of Classification Search

USPC ..... 381/400

See application file for complete search history.

(56) References Cited

U.S. PATENT DOCUMENTS 7,251,342 B2 * 7/2007 Graebener ..... H04R 9/047 381/421

9,955,267 B1 * 4/2018 Hui ..... H04R 9/06

* cited by examiner

*Primary Examiner* — Jason C Olson

(74) *Attorney, Agent, or Firm* — Schmeiser, Olsen & Watts LLP

(57) ABSTRACT

The present invention relates generally to audio speakers, and systems and methods for making audio speakers. More specifically, the present invention relates to reliable precision audio speaker coil assemblies, and systems and methods for manufacturing reliable precision audio speaker coil assemblies.

2 Claims, 27 Drawing Sheets

| 5x5 3 LANE | UOM | VALUE | | | | | | | | | |
|---|---|---|---|---|---|---|---|---|---|---|---|
| Column Width | in | 0.290 | | | | | | | | | |
| # of Columns | | 4 | | | | | | | | | |
| Lanes/ Column | | 3 | | | | | | | | | |
| # of Sides | | 1 | | | | | | | | | |
| Lane Width | in | 0.090 | | | | | | | | | |
| Lane Gap | in | 0.010 | | | | | | | | | |
| Column Spacing | in | 0.464 | | | | | | | | | |
| Column Gap | in | 0.174 | | | | | | | | | |
| Magnet Length | in | 4.000 | | | | | | | | | |
| Active Length | in | 5.000 | | | | | | | | | |
| Total Active Coil Length | in | 60.000 | | | | | | | | | |
| Base Thickness | in | 0.006 | | | | | | | | | |
| Coil Material | Grade | 1055 AL | | | | | | | | | |
| Resistivity | ohm-m | 2.95E-08 | | | | | | | | | |
| Density | g/cc | 2.70 | | | | | | | | | |
| Modulus of Elasticity | Gpa | 71 | | | | | | | | | |
| Top Inactive Lane H Width | in | 0.090 | | | | | | | | | |
| Top Inactive Coil Length | in | 10.188 | 0.354 | 0.754 | 1.154 | | | 2.242 | 2.642 | 3.042 | |
| Bottom Start Depth | in | 0.220 | | | | | | | | | |
| Bottom Inactive Lane H Width | in | 0.090 | | | | | | | | | |
| Bottom Inactive Coil H Length | in | 3.712 | 0.364 | 0.564 | | | 1.292 | 1.492 | | | |
| Bottom Inactive Lane V Width | in | 0.090 | | | | | | | | | |
| Bottom Inactive Coil V Length | in | 4.056 | 0.242 | 0.55 | 0.75 | 0.95 | 1.15 | | | | 0.414 |
| | | | | | | | | | | | |
| Resistance Tolerance | % | 0 | -1 | 1 | | | | | | | |
| Target Resistance | Ohm | 3.0000 | 2.9700 | 3.0300 | | | | | | | |
| Resistance Top Inactive | Ohm | 0.0219 | | | | | | | | | |
| Resistance Bottom Inactive #1 | Ohm | 0.0080 | | | | | | | | | |
| Resistance Bottom Inactive #2 | Ohm | 0.0087 | | | | | | | | | |
| Resistance Active | Ohm | 2.9614 | 2.9314 | 2.9914 | | | | | | | |
| Active Thickness | Micron | 6.6410 | 6.7090 | 6.5744 | | | | | | | |
| | | | | | | | | | | | |
| Old Method 4x5 (all @ 1 thickness) | | | | | | | | | | | |
| Magnet Gap | in | 0.201 | | | | | | | | | |
| Active Diaphragm Area | sq in | 18.6388 | | | | | | | | | |
| Active Tape Area | sq in | 13.9788 | | | | | | | | | |
| Coil Length @ Lane Width | in | 77.9560 | | | | | | | | | |
| Coil Thickness | Micron | 8.5174 | | | | | | | | | |
| Density of Air | g/cc | 0.001225 | | | | | | | | | |
| Density of Mylar | g/cc | 1.39 | | | | | | | | | |
| Density of Tape | g/cc | 1.26 | | | | | | | | | |
| Tape thickness | Micron | 62.5 | | | | | | | | | |
| Mylar Thickness | Micron | 25.4 | | | | | | | | | |
| Air Mass | gram | 0.024 | | | | | | | | | |
| Active Coil Mass | gram | 0.080 | | | | | | | | | |
| Active Mylar Mass | gram | 0.425 | | | | | | | | | |

FIG. 22A

| | | | | |
|---|---|---|---|---|
| Active Tape Mass | gram | 0.289 | | |
| Active Total Mass | gram | 0.793 | | |
| Service Temperature Mylar | c | 150 | | |
| | | | | |
| New Method 5x5 | | | | |
| Magnet Gap | in | 0.251 | | |
| Active Diaphragm Area | sq in | 23.6388 | | |
| Density of Parylene AF4 | g/cc | 1.32 | | |
| Modulus of Elasticity Parylene AF4 | Gpa | 2.6 | | |
| Parylene AF4 Thickness | Micron | 8.6 | | |
| Service Temperature Parylene AF4 | c | 350 | | |
| Short Term Temperature | c | 450 | | |
| % Reduction of Active Coil g/cc | % | 22.03 | 21.23 | 22.81 |
| % Reduction of Diaphragm g/cc | % | 69.65 | | |
| Increase Service Temperature | % | 133.33 | | |
| Air Mass | gram | 0.036 | | |
| Active Coil Mass | gram | 0.062 | | |
| Active Parylene AF4 Mass | gram | 0.173 | | |
| Active Tape Mass | gram | 0.000 | | |
| Active Total Mass | gram | 0.236 | | |
| % Reduction in Active Mass vs EMIM | % | 70.30 | | |
| Short Term Service Temperature | % | 200.00 | | |
| % Work required by Active Mass | % | 86.88 | | |
| % Work available for Air Mass | % | 13.12 | | |
| | | | | |
| % Work required by Old Active Mass | % | 97.09 | | |
| % Work available for Air Mass | % | 2.91 | | |
| | | | | |
| Max. Load on Coil @ Max. Deflection | N | 5.37E-07 | | |
| Max. Load on AF4 @ Max. Deflection | N | 2.31E-07 | | |
| Max. Load on Diaphragm | N | 7.68E-07 | | |

FIG. 22B

| 5x5 4 LANE | UOM | VALUE | | | | | | | | | | |
|---|---|---|---|---|---|---|---|---|---|---|---|---|
| Column Width | in | 0.290 | | | | | | | | | | |
| # of Columns | | 4 | | | | | | | | | | |
| Lanes/ Column | | 4 | | | | | | | | | | |
| # of Sides | | 1 | | | | | | | | | | |
| Lane Width | in | 0.065 | | | | | | | | | | |
| Lane Gap | in | 0.010 | | | | | | | | | | |
| Column Spacing | in | 0.464 | | | | | | | | | | |
| Column Gap | in | 0.174 | | | | | | | | | | |
| Magnet Length | in | 4.000 | | | | | | | | | | |
| Active Length | in | 5.000 | | | | | | | | | | |
| Total Active Coil Length | in | 80.000 | | | | | | | | | | |
| Base Thickness | in | 0.008 | | | | | | | | | | |
| Coil Material | Grade | 1055 AL | | | | | | | | | | |
| Resistivity | ohm-m | 2.95E-08 | | | | | | | | | | |
| Density | g/cc | 2.70 | | | | | | | | | | |
| Modulus of Elasticity | Gpa | 71 | | | | | | | | | | |
| Top Inactive Lane H Width | in | 0.065 | | | | | | | | | | |
| Top Inactive Coil Length | in | 13.184 | 0.304 | 0.604 | 0.904 | 1.204 | | 2.092 | 2.392 | 2.692 | 2.992 | |
| Bottom Start Depth | in | 0.220 | | | | | | | | | | |
| Bottom Inactive Lane H Width | in | 0.055 | | | | | | | | | | |
| Bottom Inactive Coil H Length | in | 5.568 | 0.314 | 0.464 | 0.614 | | 1.242 | 1.392 | 1.542 | | | |
| Bottom Inactive Lane V Width | in | 0.065 | | | | | | | | | | |
| Bottom Inactive Coil V Length | in | 5.634 | 0.2295 | 0.515 | 0.645 | 0.775 | 0.905 | 1.035 | 1.165 | | | 0.364 |
| | | | | | | | | | | | | |
| Resistance Tolerance | % | 0 | -1 | 1 | | | | | | | | |
| Target Resistance | Ohm | 3.0000 | 2.9700 | 3.0300 | | | | | | | | |
| Resistance Top Inactive | Ohm | 0.0294 | | | | | | | | | | |
| Resistance Bottom Inactive #1 | Ohm | 0.0147 | | | | | | | | | | |
| Resistance Bottom Inactive #2 | Ohm | 0.0126 | | | | | | | | | | |
| Resistance Active | Ohm | 2.9433 | 2.9133 | 2.9733 | | | | | | | | |
| Active Thickness | Micron | 12.3358 | 12.4628 | 12.2113 | | | | | | | | |
| | | | | | | | | | | | | |
| Old Method 4x5 (all @ 1 thickness) | | | | | | | | | | | | |
| Magnet Gap | in | 0.201 | | | | | | | | | | |
| Active Diaphragm Area | sq in | 18.6388 | | | | | | | | | | |
| Active Tape Area | sq in | 13.9788 | | | | | | | | | | |
| Coil Length @ Lane Width | in | 103.5289 | | | | | | | | | | |
| Coil Thickness | Micron | 15.6620 | | | | | | | | | | |
| Density of Air | g/cc | 0.001225 | | | | | | | | | | |
| Density of Mylar | g/cc | 1.39 | | | | | | | | | | |
| Density of Tape | g/cc | 1.26 | | | | | | | | | | |
| Tape thickness | Micron | 62.5 | | | | | | | | | | |
| Mylar Thickness | Micron | 25.4 | | | | | | | | | | |
| Air Mass | gram | 0.024 | | | | | | | | | | |
| Active Coil Mass | gram | 0.142 | | | | | | | | | | |
| Active Mylar Mass | gram | 0.425 | | | | | | | | | | |

FIG. 23A

| | | |
|---|---|---|
| Active Tape Mass | gram | 0.289 |
| Active Total Mass | gram | 0.855 |
| Service Temperature Mylar | c | 150 |
| | | |
| New Method 5x5 | | |
| Magnet Gap | in | 0.251 |
| Active Diaphragm Area | sq in | 23.6388 |
| Density of Parylene AF4 | g/cc | 1.32 |
| Modulus of Elasticity Parylene AF4 | Gpa | 2.6 |
| Parylene AF4 Thickness | Micron | 8.6 |
| Service Temperature Parylene AF4 | c | 350 |
| Short Term Temperature | c | 450 |
| % Reduction of Active Coil g/cc | % | 21.24 |
| % Reduction of Diaphragm g/cc | % | 69.65 |
| Increase Service Temperature | % | 133.33 |
| Air Mass | gram | 0.036 |
| Active Coil Mass | gram | 0.112 |
| Active Parylene AF4 Mass | gram | 0.173 |
| Active Tape Mass | gram | 0.000 |
| Active Total Mass | gram | 0.285 |
| % Reduction in Active Mass | % | 66.68 |
| Short Term Service Temperature | % | 200.00 |
| % Work required by Active Mass | % | 88.90 |
| % Work available for Air Mass | % | 11.10 |
| | | |
| % Work required by Old Active Mass | % | 97.29 |
| % Work available for Air Mass | % | 2.71 |
| | | |
| Max. Load on Coil @ Max. Deflection | N | 3.31E-06 |
| Max. Load on AF4 @ Max. Deflection | N | 2.31E-07 |
| Max. Load on Diaphragm | N | 3.54E-06 |

FIG. 23B

| 5x5 5 LANE | UOM | VALUE | | | | | | | | | | |
|---|---|---|---|---|---|---|---|---|---|---|---|---|
| Column Width | in | 0.290 | | | | | | | | | | |
| # of Columns | | 4 | | | | | | | | | | |
| Lanes/ Column | | 5 | | | | | | | | | | |
| # of Sides | | 1 | | | | | | | | | | |
| Lane Width | in | 0.050 | | | | | | | | | | |
| Lane Gap | in | 0.010 | | | | | | | | | | |
| Column Spacing | in | 0.469 | | | | | | | | | | |
| Column Gap | in | 0.179 | | | | | | | | | | |
| Magnet Length | in | 4.000 | | | | | | | | | | |
| Active Length | in | 5.000 | | | | | | | | | | |
| Total Active Coil Length | in | 100.000 | | | | | | | | | | |
| Base Thickness | in | 0.012 | | | | | | | | | | |
| Coil Material | Grade | 1055 AL | | | | | | | | | | |
| Resistivity | ohm-m | 2.95E-08 | | | | | | | | | | |
| Density | g/cc | 2.70 | | | | | | | | | | |
| Modulus of Elasticity | Gpa | 71 | | | | | | | | | | |
| Top Inactive Lane H Width | in | 0.050 | | | | | | | | | | |
| Top Inactive Coil Length | in | 16.280 | 0.279 | 0.519 | 0.759 | 0.999 | 1.239 | 2.017 | 2.257 | 2.497 | 2.737 | 2.977 |
| Bottom Start Depth | in | 0.220 | | | | | | | | | | |
| Bottom Inactive Lane H Width | in | 0.040 | | | | | | | | | | |
| Bottom Inactive Coil H Length | in | 7.504 | 0.289 | 0.409 | 0.529 | 0.649 | 1.227 | 1.347 | 1.467 | 1.587 | | |
| Bottom Inactive Lane V Width | in | 0.050 | | | | | | | | | | |
| Bottom Inactive Coil V Length | in | 7.364 | 0.2245 | 0.5 | 0.6 | 0.7 | 0.8 | 0.9 | 1 | 1.1 | 1.2 | 0.339 |
| | | | | | | | | | | | | |
| Resistance Tolerance | % | 0 | -1 | 1 | | | | | | | | |
| Target Resistance | Ohm | 3.000 | 2.97 | 3.03 | | | | | | | | |
| Resistance Top Inactive | Ohm | 0.0315 | | | | | | | | | | |
| Resistance Bottom Inactive #1 | Ohm | 0.0182 | | | | | | | | | | |
| Resistance Bottom Inactive #2 | Ohm | 0.0143 | | | | | | | | | | |
| Resistance Active | Ohm | 2.9361 | 2.9061 | 2.9661 | | | | | | | | |
| Active Thickness | Micron | 20.0948 | 20.3022 | 19.8916 | | | | | | | | |
| | | | | | | | | | | | | |
| Old Method 4x5 (all @ 1 thickness) | | | | | | | | | | | | |
| Magnet Gap | in | 0.201 | | | | | | | | | | |
| Active Diaphragm Area | sq in | 18.6388 | | | | | | | | | | |
| Active Tape Area | sq in | 13.9038 | | | | | | | | | | |
| Coil Length @ Lane Width | in | 129.6467 | | | | | | | | | | |
| Coil Thickness | Micron | 25.50 | | | | | | | | | | |
| Density of Air | g/cc | 0.001225 | | | | | | | | | | |
| Density of Mylar | g/cc | 1.39 | | | | | | | | | | |
| Density of Tape | g/cc | 1.26 | | | | | | | | | | |
| Tape thickness | Micron | 62.50 | | | | | | | | | | |
| Mylar Thickness | Micron | 25.4 | | | | | | | | | | |
| Air Mass | gram | 0.024 | 0.024 | | | | | | | | | |
| Active Coil Mass | gram | 0.222 | 0.284 | | | | | | | | | |
| Active Mylar Mass | gram | 0.425 | 0.425 | | | | | | | | | |

FIG. 24A

| | | | | |
|---|---|---|---|---|
| Active Tape Mass | gram | 0.287 | 0.287 | |
| Active Total Mass | gram | 0.934 | 0.995 | |
| Service Temperature Mylar | c | 150 | 150 | |
| | | | | |
| New Method 5x5 | | | | |
| Magnet Gap | in | 0.251 | | |
| Active Diaphragm Area | sq in | 23.6388 | | |
| Density of Parylene AF4 | g/cc | 1.32 | | |
| Modulus of Elasticity Parylene AF4 | Gpa | 2.6 | | |
| Parylene AF4 Thickness | Micron | 8.6 | | |
| Service Temperature Parylene AF4 | c | 350 | | |
| Short Term Temperature | c | 450 | | |
| % Reduction of Active Coil g/cc | % | 21.19 | | |
| % Reduction of Diaphragm g/cc | % | 69.65 | | |
| Increase Service Temperature | % | 133.33 | | |
| Air Mass | gram | 0.036 | | |
| Active Coil Mass | gram | 0.175 | | |
| Active Parylene AF4 Mass | gram | 0.173 | | |
| Active Tape Mass | gram | 0.000 | | |
| Active Total Mass | gram | 0.348 | | |
| % Reduction in Active Mass | % | 65.03 | | |
| Short Term Service Temperature | % | 200.00 | | |
| % Work required by Active Mass | % | 90.71 | | |
| % Work available for Air Mass | % | 9.29 | | |
| | | | | |
| % Work required by Old Active Mass | % | 97.51 | | |
| % Work available for Air Mass | % | 2.49 | | |
| | | | | |
| Max. Load on Coil @ Max. Deflection | N | 1.3771E-05 | 1.4202E-05 | 1.33573E-05 |
| Max. Load on AF4 @ Max. Deflection | N | 2.3119E-07 | | |
| Max. Load on Diaphragm | N | 1.4002E-05 | 1.4433E-05 | 1.35885E-05 |

FIG. 24B

PRECISION AUDIO SPEAKER COIL ASSEMBLY AND METHOD FOR MAKING SAME

CROSS REFERENCE TO RELATED APPLICATION[S]

This application claims priority to earlier U.S. patent application entitled "PRECISION AUDIO SPEAKER COIL ASSEMBLY AND METHOD FOR MAKING SAME," Ser. No. 15/893,223, filed Feb. 9, 2018, which claims priority to Provisional Patent entitled "PRECISION AUDIO SPEAKER COIL ASSEMBLY AND METHOD FOR MAKING SAME," Ser. No. 62/457,003, filed Feb. 9, 2017, the disclosures of which are hereby incorporated entirely herein by reference.

BACKGROUND OF THE INVENTION

Technical Field of the Invention

The present invention relates generally to audio speakers, and systems and methods for making audio speakers. More specifically, the present invention relates to reliable precision audio speaker coil assemblies, and systems and methods for manufacturing reliable precision audio speaker coil assemblies.

Audio speakers are commonly used in various systems, including home audio systems, automotive audio systems, business audio systems, and other environments to reproduce, as accurately as possible, audio programs for the pleasure or edification of listeners of the audio system. Especially with respect to systems utilized for the playback of music, it is desired that the audio speakers be designed and manufactured to reproduce the audio programs with maximum fidelity to the original source musical program. In addition, it is desirable that the audio speakers be designed and manufactured to provide reliable service over as long a time period as possible.

Audio coils are a component of audio speakers that are critical to the process of accurately reproducing audio programs in the speakers. One method currently used to create audio coils, including, for example, tweeters and mid-range, is to physically attach aluminum to a diaphragm by means of an adhesive. The aluminum that is thus attached to the diaphragm may subsequently be etched away to provide coils and other audio speaker structures. However, this method is suboptimal, in that the adhesive frequently breaks down due to heat and stress, causing various speaker components to fail.

More specifically, in one example, Aluminum foil is attached to one or both sides of a plastic film by the use of adhesive. In this case, the length of the coil is determined by the size of the transducer, the size of the magnets, the size of the opening for the audio signal, and the number of turns in the coil. To achieve a desired impedance value for the audio speaker requires a certain cross sectional area for the electrical coil. Current speaker designs would require aluminum foil having a thickness less than 25 microns to achieve a typical desired impedance value. However, Aluminum foil having a thickness of less than 25 microns typically has pinholes created by the production process to create the foil. These pinholes create "hot spots" that increase resistance and reduce the coil cross section in a random, haphazard manner. Obtaining pinhole-free Aluminum foil with a thickness of less than 25 microns is very expensive.

In addition, typical plastic films to which the Aluminum foil is attached (such as, for example, polyester (Mylar), polyimide (Kapton), PEN (Teonex), PEEK (VICTREX) all require adhesive to attach the Aluminum foil to the film. This adhesive adds mass to the diaphragm of the speaker coil, reducing the ability of the speaker coil to accelerate, and adding distortion to the audio waves produced by the audio speaker in response to the audio signal provided to the speaker. Furthermore, although the films may be able to withstand high temperatures (for example, Polyimide film can withstand approximately 400 degrees Celsius, PEEK film can withstand approximately 220 degrees Celsius, polyester film can withstand approximately 150 degrees Celsius, and PEN film can withstand approximately 150 degrees Celsius), if the adhesive used to bond the aluminum foil to the plastic film cannot withstand those temperatures, the adhesive becomes the thermal limiter of the coil assembly. This can cause the aluminum foil to separate from the film, and cracking in the structures due to heat and stress, resulting in speaker failure. Furthermore, adhesives capable of withstanding 400 degrees Celsius are costly and seldom used.

It would be useful to provide an adhesive-free speaker coil assembly having precisely definable, pinhole-free metal thicknesses and resistances, and a method for making such a speaker coil assembly.

BRIEF DESCRIPTION OF THE DRAWINGS

A more complete understanding of the present invention may be derived by referring to the detailed description when considered in connection with the Figures (not necessarily drawn to scale), wherein like reference numbers refer to similar items throughout the Figures, and:

FIG. 22A is a spreadsheet generally illustrating performance enhancements and benefits of coils of a three-lane coil embodiment of the present invention relative to other coils not made according to the present invention;

FIG. 22B is a spreadsheet generally illustrating performance enhancements and benefits of coils of a three-lane coil embodiment of the present invention relative to other coils not made according to the present invention;

FIG. 23A is a spreadsheet generally illustrating performance enhancements and benefits of coils of a four-lane coil embodiment of the present invention relative to other coils not made according to the present invention;

FIG. 23B is a spreadsheet generally illustrating performance enhancements and benefits of coils of a four-lane coil embodiment of the present invention relative to other coils not made according to the present invention;

FIG. 24A is a spreadsheet generally illustrating performance enhancements and benefits of coils of a five-lane coil embodiment of the present invention relative to other coils not made according to the present invention; and FIG. 24B is a spreadsheet generally illustrating performance enhancements and benefits of coils of a five-lane coil embodiment of the present invention relative to other coils not made according to the present invention.

DETAILED DESCRIPTION

Figure 1:
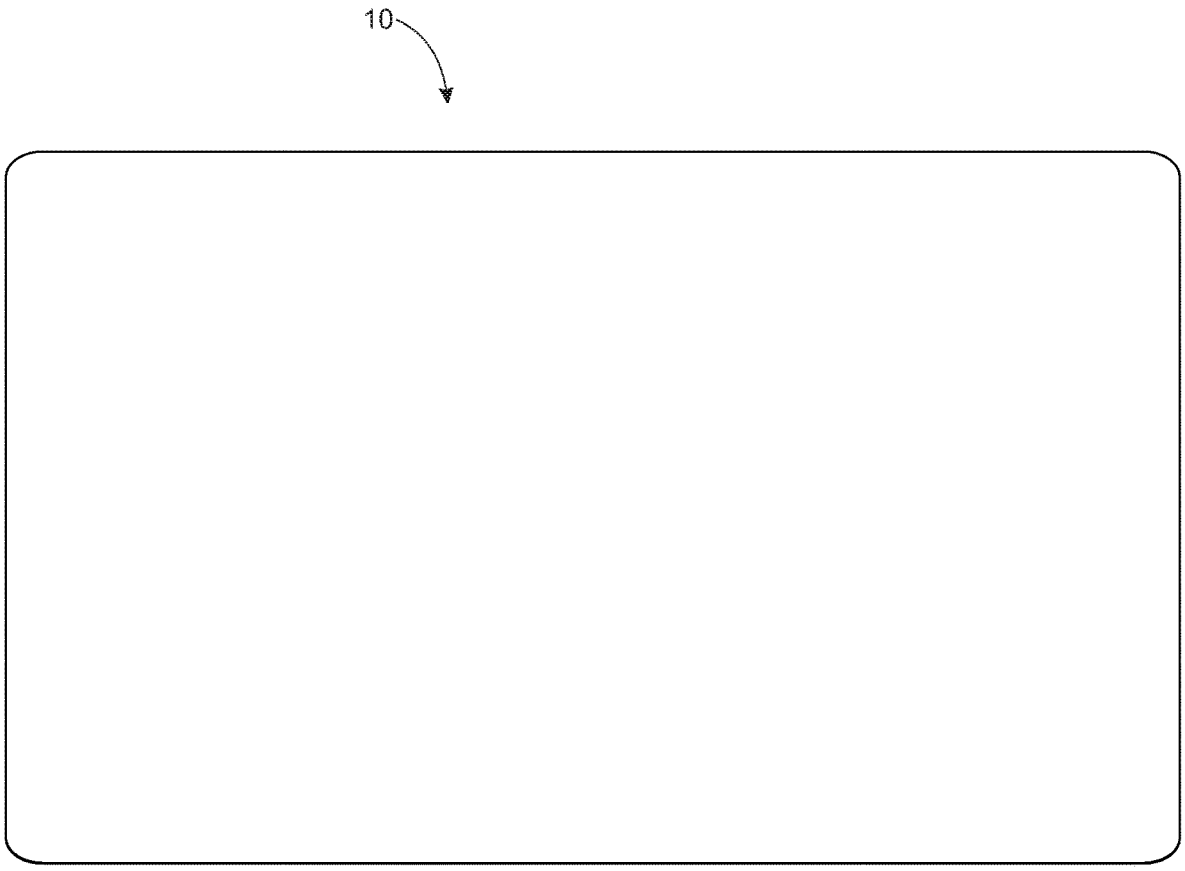
FIG. 1 is a general illustration of an electrically conducting plate prior to processing in accordance with the teaching of an embodiment of the present invention.

FIG. 1 is a general illustration of an electrically conducting plate prior to processing in accordance with the teaching of an embodiment of the present invention. In the present embodiment, each Electrically Conducting Plate 10 is made of aluminum and has approximate dimensions of 335 mm long by 485 mm wide by 0.20 mm (0.008") thick. More specifically, in the present embodiment, Electrically Conducting Plate 10 is a Kodak brand Sonora XP process-free plate that is aluminum grade 1050 (99.50% aluminum) and has the above-noted dimensions. In alternative embodiments, Electrically Conducting Plate 10 may be made of materials other than aluminum, provided that the material is capable of conducting electrical signals. In alternative embodiments, Electrically Conducting Plate 10 may have other length, width, and thickness dimensions. In an alternative embodiment, Electrically Conducting Plate 10 has a thickness of approximately 0.40 mm, a width of approximately 1348 mm, and a height of approximately 2898 mm.

Figure 2:
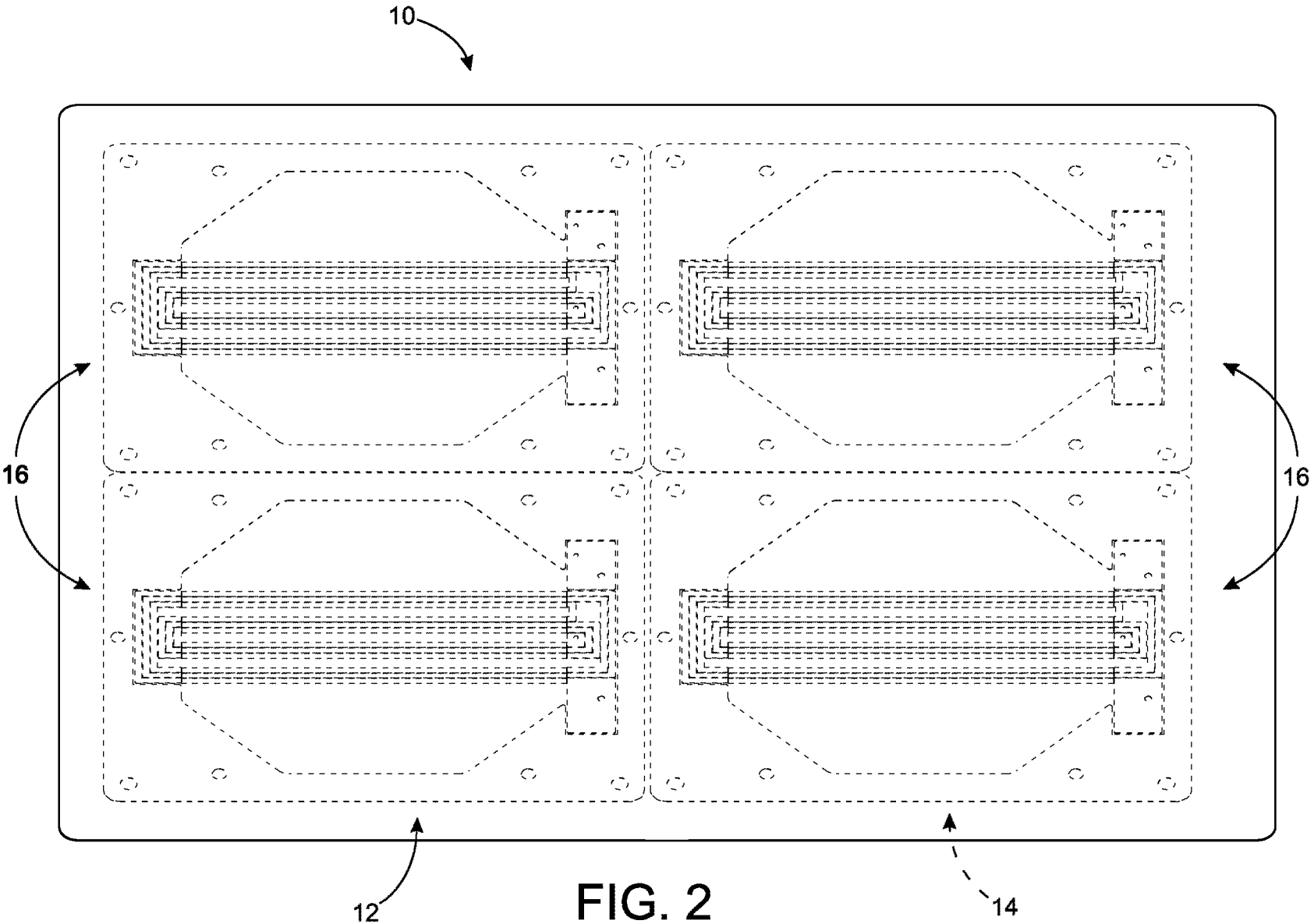
FIG. 2 is a top view of the aluminum plate of FIG. 1 after desired images have been fixed on the aluminum plate, in accordance with an embodiment of the present invention.

FIG. 2 is a top view of the aluminum plate of FIG. 1 after desired images have been fixed on the aluminum plate, in accordance with an embodiment of the present invention. In the present embodiment, each desired image 16 is the same on Electrically Conducting Plate 10. Consequently, Electrically Conducting Plate 10 has two sides: an image side 12 (the side on which an image 16 is fixed), and a non-image side 14 on which no image has been fixed. In the present embodiment, each coil/diaphragm image 16 is initially created in a CAD or other software program and saved to a file format such as PDF. Each image 16 is then fixed on the plate utilizing a computer-to-plate ("CTP") that is generally known. It should be appreciated that although in the present embodiment, each image 16 is identical, in alternative embodiments, Electrically Conducting Plate 10 may have a different image on its respective image side 12.

Figure 3A:
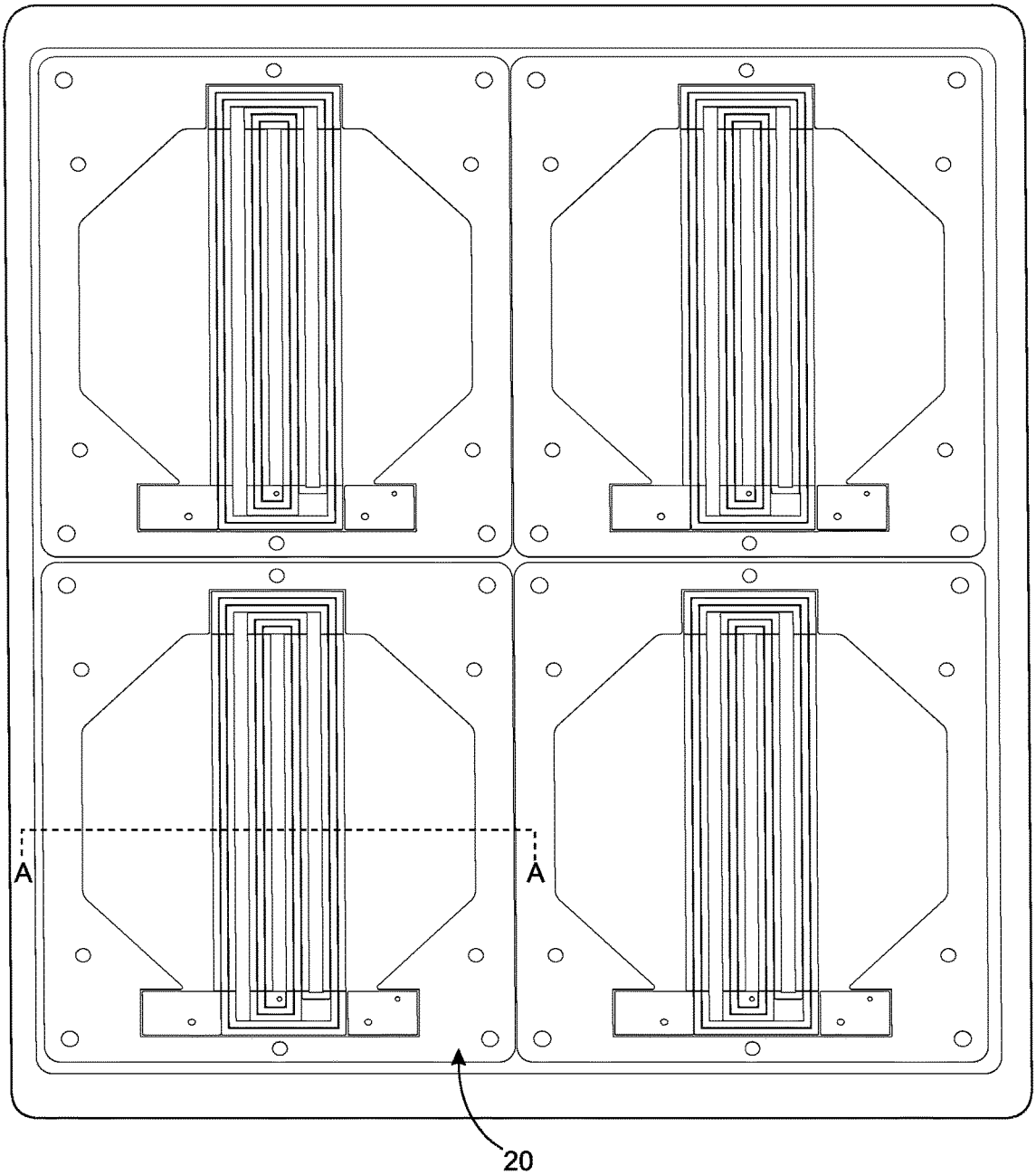
FIG. 3A is a top view of the aluminum plate of FIG. 2 after the image sides of the plate has been coated with an alkaline-resistant ink, in accordance with an embodiment of the present invention.
Figure 3B:
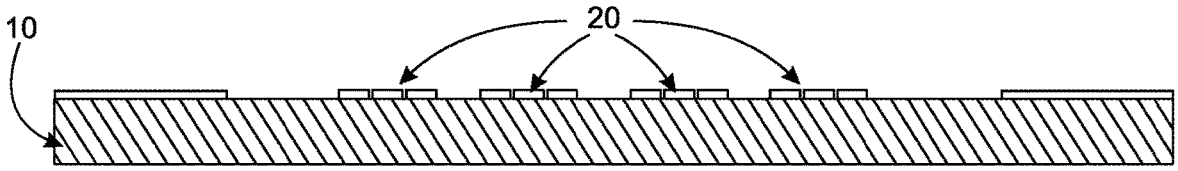
FIG. 3B is general illustration of a cross-section taken through a portion of the aluminum plate of FIG. 3A.

FIG. 3A is a top view of the aluminum plate of FIG. 2 after the image sides of the plate has been coated with an alkaline-resistant ink, in accordance with an embodiment of the present invention. FIG. 3B is a cross-section of the portion of the aluminum plate of FIG. 3A. In the present embodiment, the ink 20 is applied to the image-side of the plate, and subsequently baked at 350 degrees Fahrenheit for 1 hour. In the present embodiment, the ink 20 is made such that after being applied and baked for 1 hour at 350 degrees Fahrenheit, it cannot be removed in a caustic etch of 3% by weight NaOH and DI water. It should be appreciated that in alternative embodiments, alternative inks may be utilized and baked for different durations, provided that the ink may not be removed in a caustic etch such as, for example, NaOH.

Figure 4:
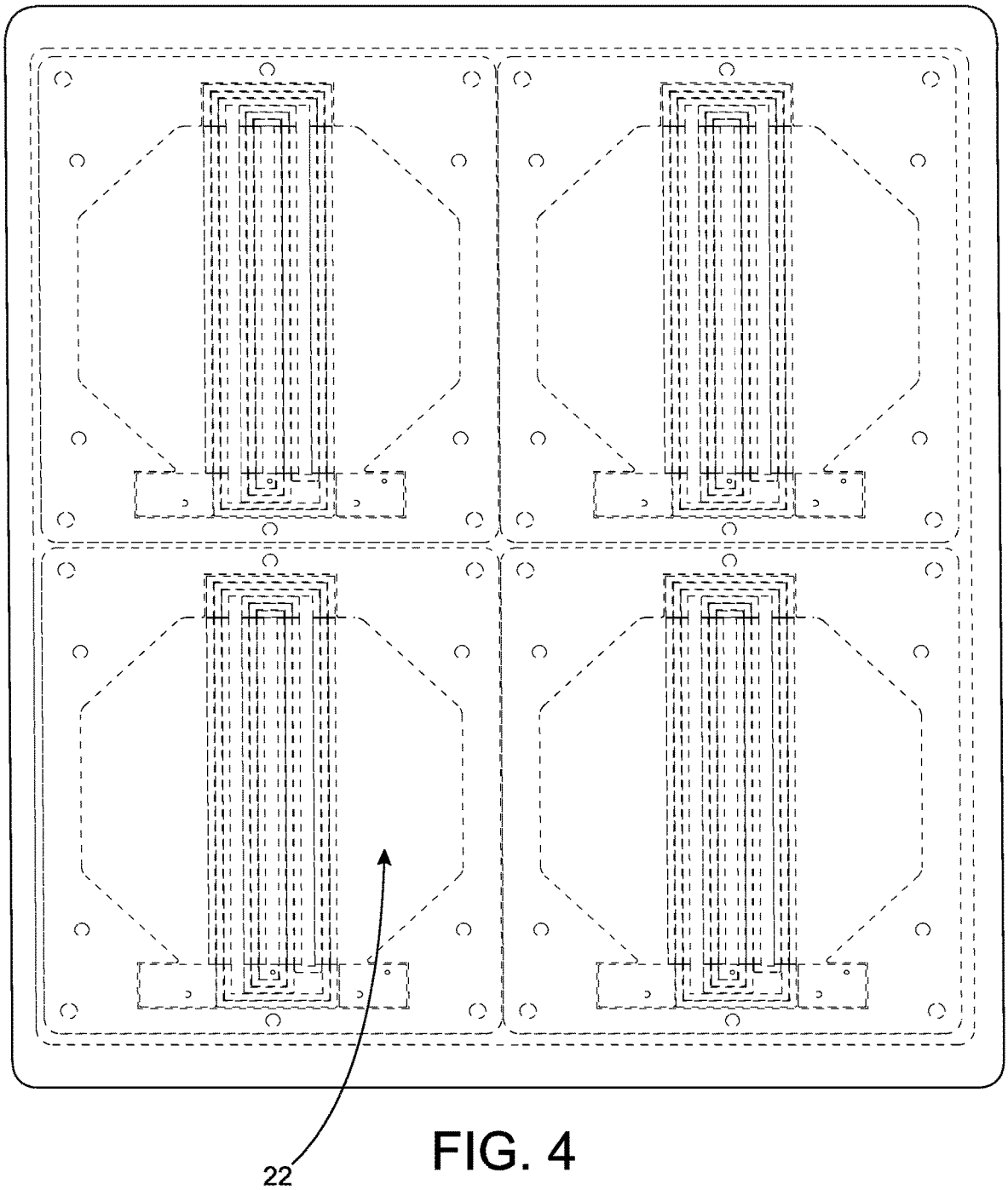
FIG. 4 is a top view of the aluminum plate of FIG. 3 after the image side of the plate has been coated with a peelable maskant, in accordance with an embodiment of the present invention.

FIG. 4 is a top view of the aluminum plate of FIG. 3 after the image sides of the plate has been coated with a peelable maskant, in accordance with an embodiment of the present invention. More specifically, in the present embodiment, a low-adherence, peelable maskant 22 is applied to image side 12 of Electrically Conducting Plate 10 utilizing a "Maxit" coater produced by Daige. The low-tack fugitive-bond peelable maskant 22 utilized is number 8254 produced by Cattie Adhesives. In the present embodiment, the entire image side 12 of Electrically Conducting Plate 10 is coated with peelable maskant 22. In the present embodiment, peelable maskant 22 is applied such that no holes, air bubbles, or gaps are present in order to prevent subsequent coatings applied to Electrically Conducting Plate 10 from being deposited on image side 12. In alternative embodiments, other peelable, low-adherence maskants, including solvent-based maskants, may be used, and these maskants may be applied by air sprayers, brushes, rollers, or by dipping the image side 12 of Electrically Conducting Plate 10 in the maskant, or by alternative means.

Figure 5:
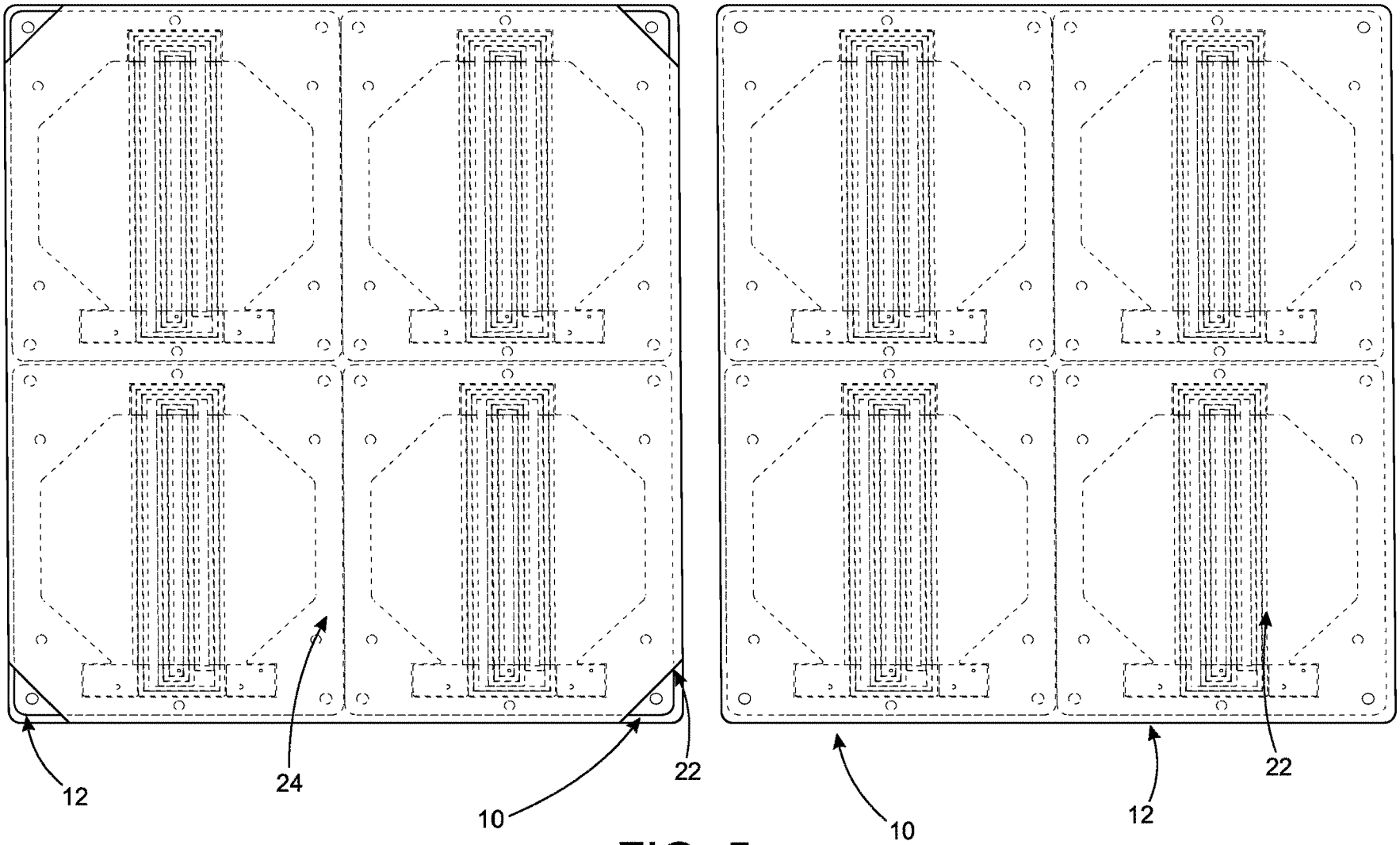
FIG. 5 is a top view of multiple aluminum plates of FIG. 4 just before they are combined into a unit for further processing, in accordance with an embodiment of the present invention.

FIG. 5 is a top view of multiple aluminum plates of FIG. 4 just before they are combined into a unit for further processing, in accordance with an embodiment of the present invention. In the present embodiment, a unit 30 (shown later in FIG. 6) will be formed by positioning each Electrically Conducting Plate 10 such that the image sides 12 of each Electrically Conducting Plate 10 are facing each other, positioning a barrier 24 between the image sides 12 of the ECPs10, and then pushing the Electrically Conducting Plates together, sandwiching the barrier 24 between each Electrically Conducting Plate 10. It should be appreciated that placing the barrier 24 between the image sides 12 of Electrically Conducting Plates 10 will prevent the peelable maskant 22 applied to the image sides 12 from sticking together. In the present embodiment, barrier 24 is parchment paper. In alternative embodiments, barrier 24 may be other materials provided that barrier 24 prevents the peelable maskant 22 applied to each image side 12 of each Electrically Conducting Plate 10 from sticking together. In alternative embodiments, it might be possible to form unit 30 without barrier 24 if peelable maskant 22 is of a material that would not cause the image sides 12 of Electrically Conducting Plates 10 to stick together. In a further step (not shown), once unit 30 is formed, the exposed surfaces of unit 30 (the edges of unit 30 and each non-image side 14 of each Electrically Conducting Plate 10) are cleaned. In the present embodiment, the exposed surfaces of unit 30 are wiped with Allied Press Control CTP+ fountain solution mixed 3-6 ounces per gallon of water, then with an acetone, and then with 2-propanol and DI water. In alternative embodiments, the exposed surfaces of unit 30 may be cleaned by other means, including by other solutions, provided that the exposed surfaces of unit 30 are cleaned sufficient to allow the material applied in subsequent steps to adhere to the exposed surfaces of unit 30.

Figure 6:
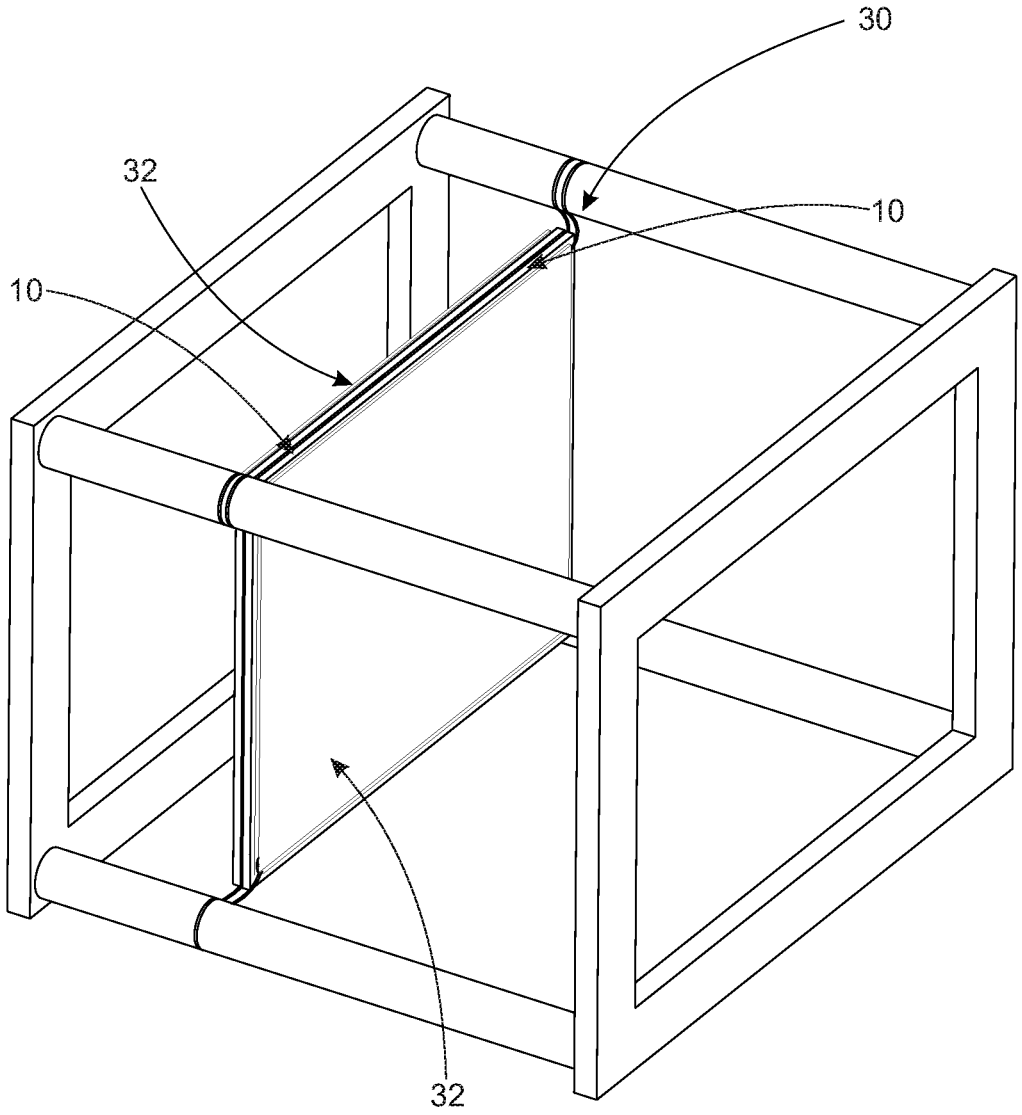
FIG. 6 is a perspective view of the unit of FIG. 5 having a coating applied to its exposed surfaces, in accordance with an embodiment of the present invention.

FIG. 6 is a perspective view generally illustrating the unit of FIG. 5 having a coating applied to its exposed surfaces, in accordance with an embodiment of the present invention. In an embodiment, the coating is a conformal coating. In the present embodiment, the coating 32 applied to unit 30 is Parylene AF4, and is applied to a thickness of 8.6 microns. A test was conducted with a tweeter design having 9 different coil widths and spacing's. 6 plates were made with Parylene C applied at 3 microns, 5 microns, 7 microns, 9 microns, 11 microns and 13 microns. The plates were produced using the methods described in this document. 54 tweeters were produced all with a 4 Ohm resistance. Tests on all 54 showed that a 7 micron Parylene-C film had the best frequency response data. Comparing the tensile modulus variance of Parylene AF4 to Parylene-C gives 8.6 micron for Parylene AF-4 for equal strength. In an alternative embodiment, the thickness of the coating 32 is determined based on the desired frequency response and harmonic distortion for a given coil/diaphragm size.

Figure 7:
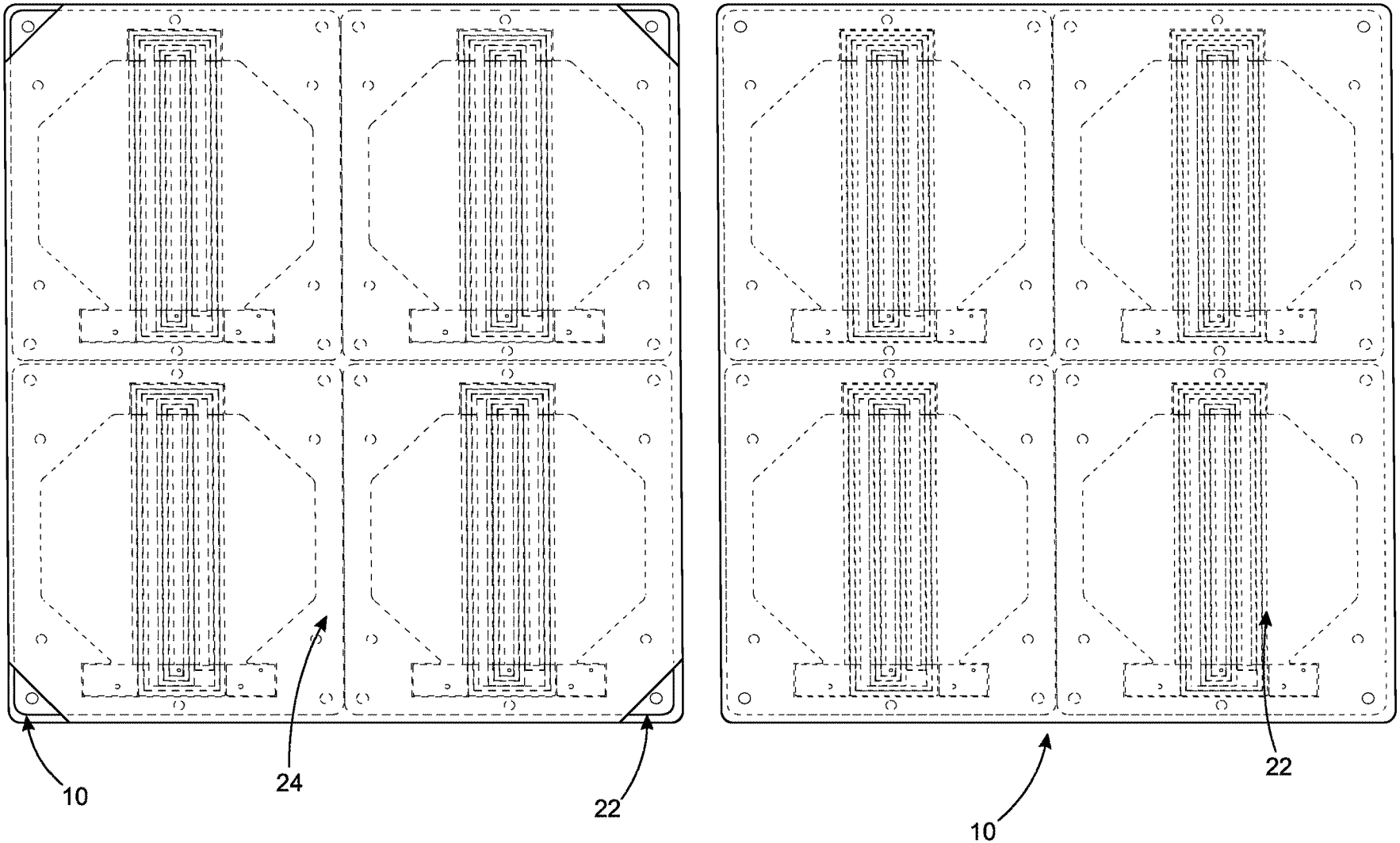
FIG. 7 is a top view of the plates of FIG. 6 after they have been separated, in accordance with an embodiment of the present invention.

FIG. 7 is a top view of the plates of FIG. 6 after they have been separated, in accordance with an embodiment of the present invention. In the present embodiment, unit 30 is disassembled by pulling each Electrically Conducting Plate 10 in opposite directions. After unit 30 has been disassembled, barrier 24 is removed, exposing the surface of peelable maskant 22 on the image side 12 of each Electrically Conducting Plate 10.

Figure 8:
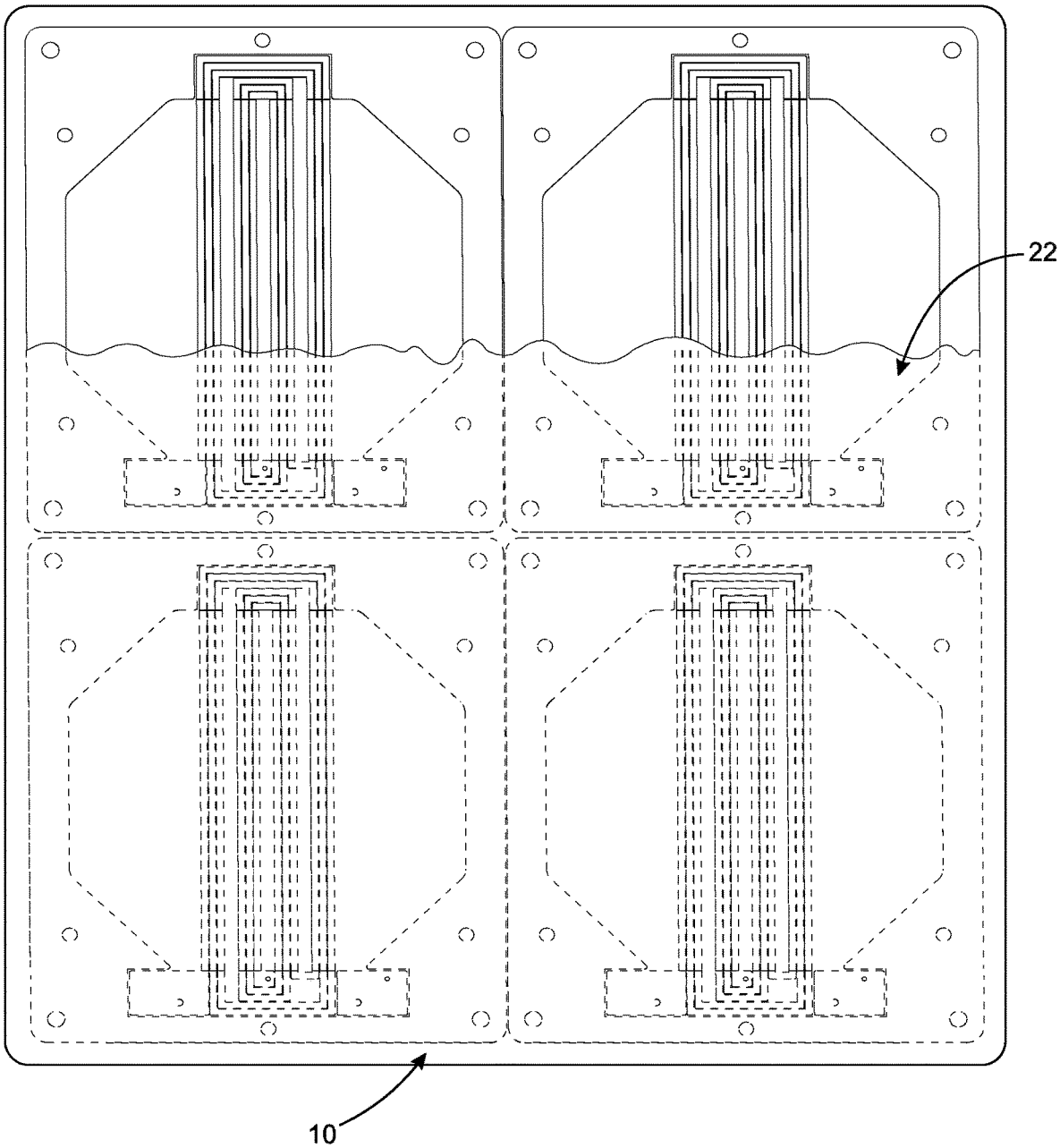
FIG. 8 is a top view of one of the plates of FIG. 7 after the peelable maskant has been removed, in accordance with an embodiment of the present invention.

FIG. 8 is a top view of one of the plates of FIG. 7 after the peelable maskant has been removed, in accordance with an embodiment of the present invention. In the present embodiment, peelable maskant 22 is removed by pulling it off of the image side 12 of each Electrically Conducting Plate 10.

Figure 9A:
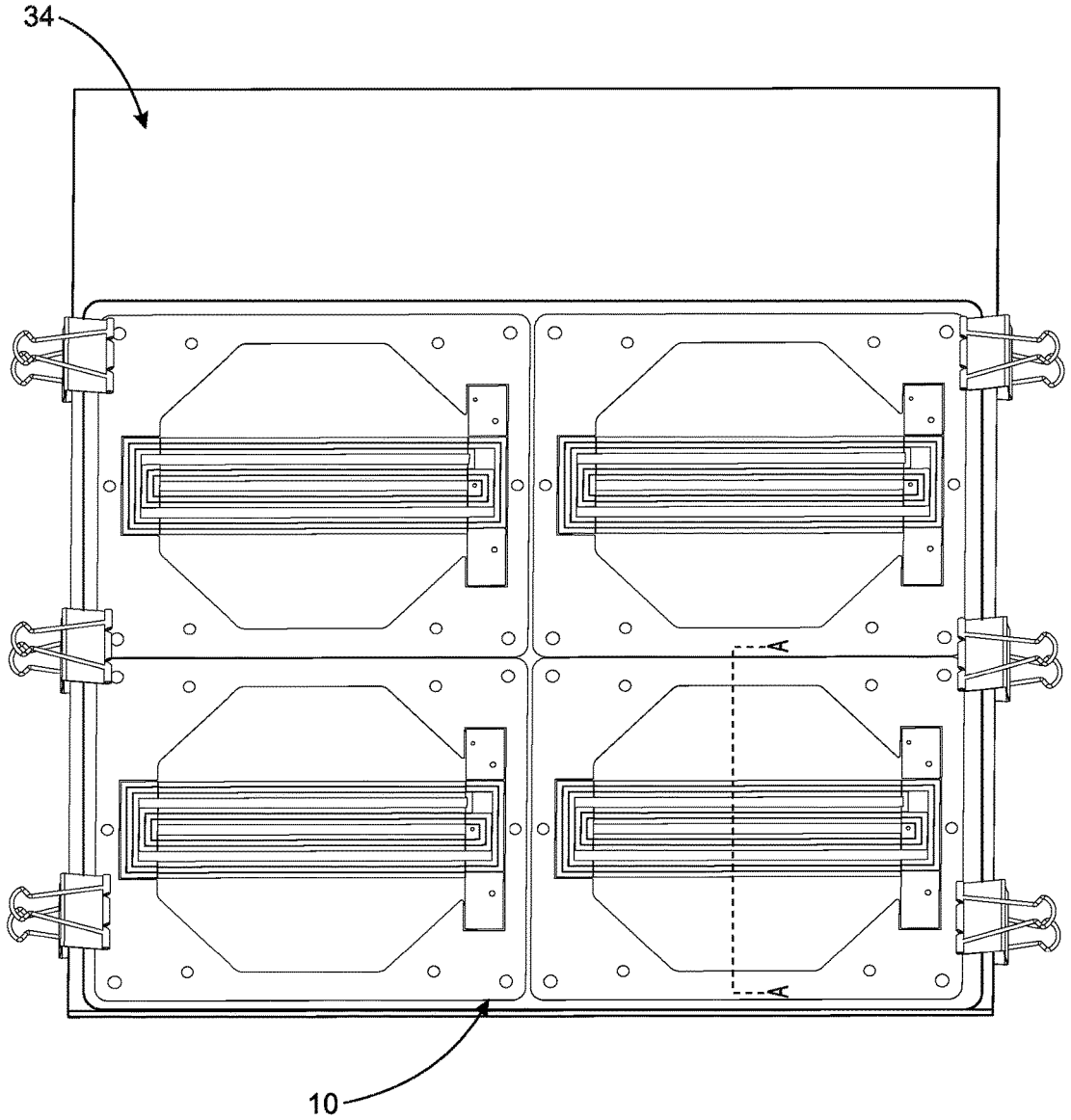
FIG. 9A is a top view of the plate of FIG. 8 having its non-imaged sides secured to a backing, in accordance with an embodiment of the present invention.
Figure 9B:
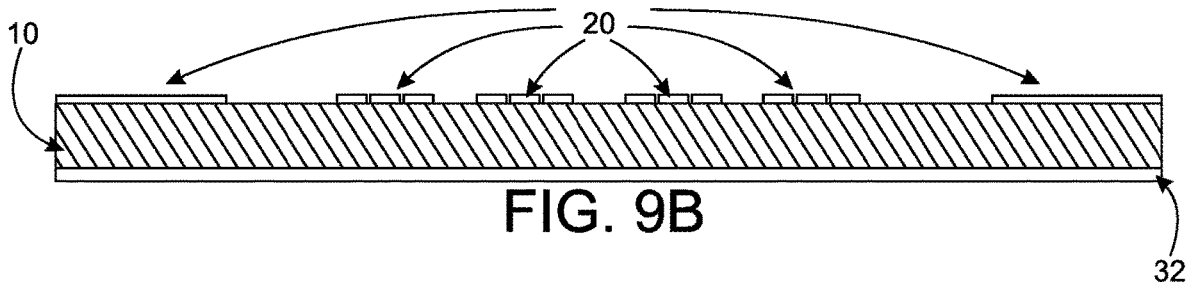
FIG. 9B is a general illustration of a cross-section taken through a portion of the plate of FIG. 9A.

FIG. 9A is a top view of the plate of FIG. 8 having its non-imaged side secured to a backing, in accordance with an embodiment of the present invention. FIG. 9B is a cross-section of a portion of the plate of FIG. 9A. In the present embodiment, each non-image side 14 of each Electrically Conducting Plate 10 is secured to a 0.125" thick sheet of PVC plastic as a backing material 34, leaving each image side 12 exposed. In alternative embodiments, the backing material 34 may be a material other than PVC or plastic, such as, for example stainless steel.

Figure 10A:
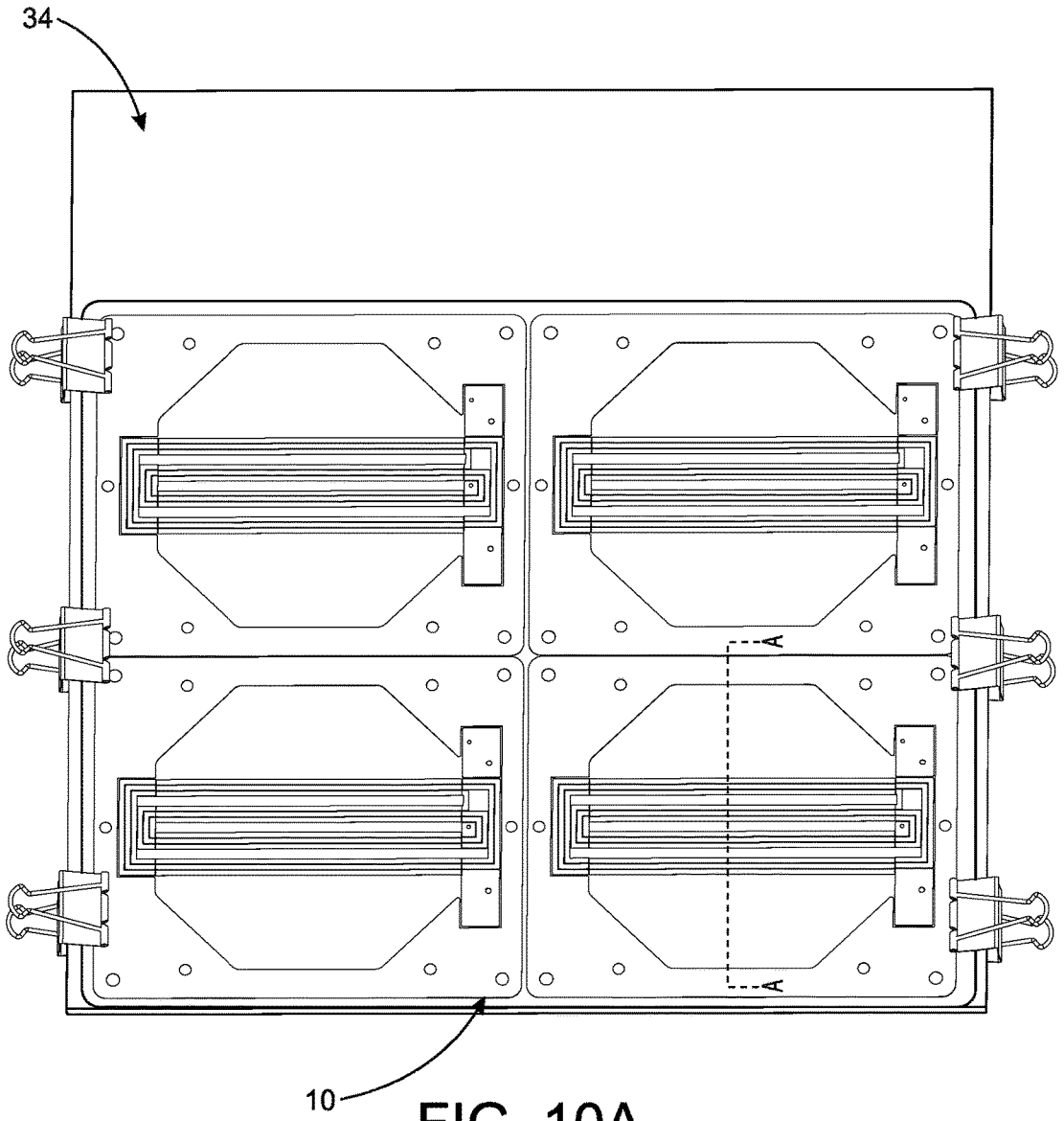
FIG. 10A is a top view of the plate of FIG. 9 after it has had material removed by etching, in accordance with an embodiment of the present invention.
Figure 10B:
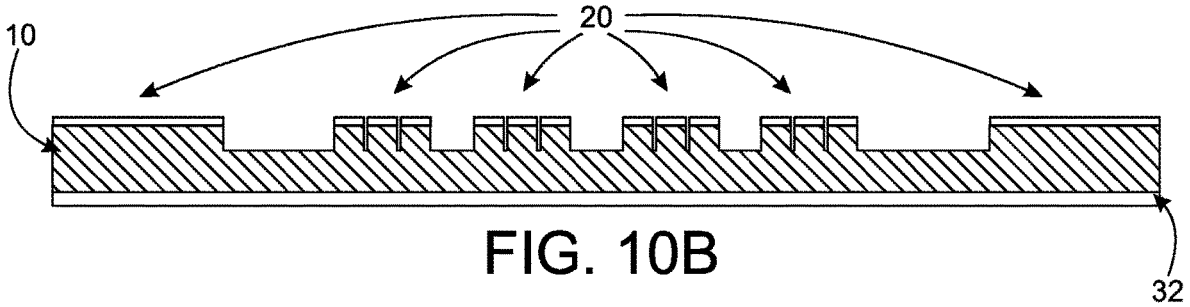
FIG. 10B is a general illustration of a cross-section taken through a portion of the plate of FIG. 10A.

FIG. 10A is a top view of the plate of FIG. 9 after it has had material removed by etching, in accordance with an embodiment of the present invention. FIG. 10B is a cross-section of a portion of the plate of FIG. 10B. In the present embodiment, the material is removed by placing each Electrically Conducting Plate 10 in an alkaline etch solution to remove approximately 0.05 mm of aluminum. More specifically, each Electrically Conducting Plate 10 is placed in a sonic-vibrated etch tank having a solution of 3% by weight of NaOH and DI at a temperature of approximately 20 degrees Centigrade. This provides an approximate etch rate of 4,200 Angstroms per minute. Each Electrically Conducting Plate 10 is etched for approximately 2 hours, and is turned 180 degrees every 30 minutes to provide for an even etch rate. It should be appreciated that in alternative embodiments, more or less aluminum may be removed, the duration of etching may be altered.

Figure 11A:
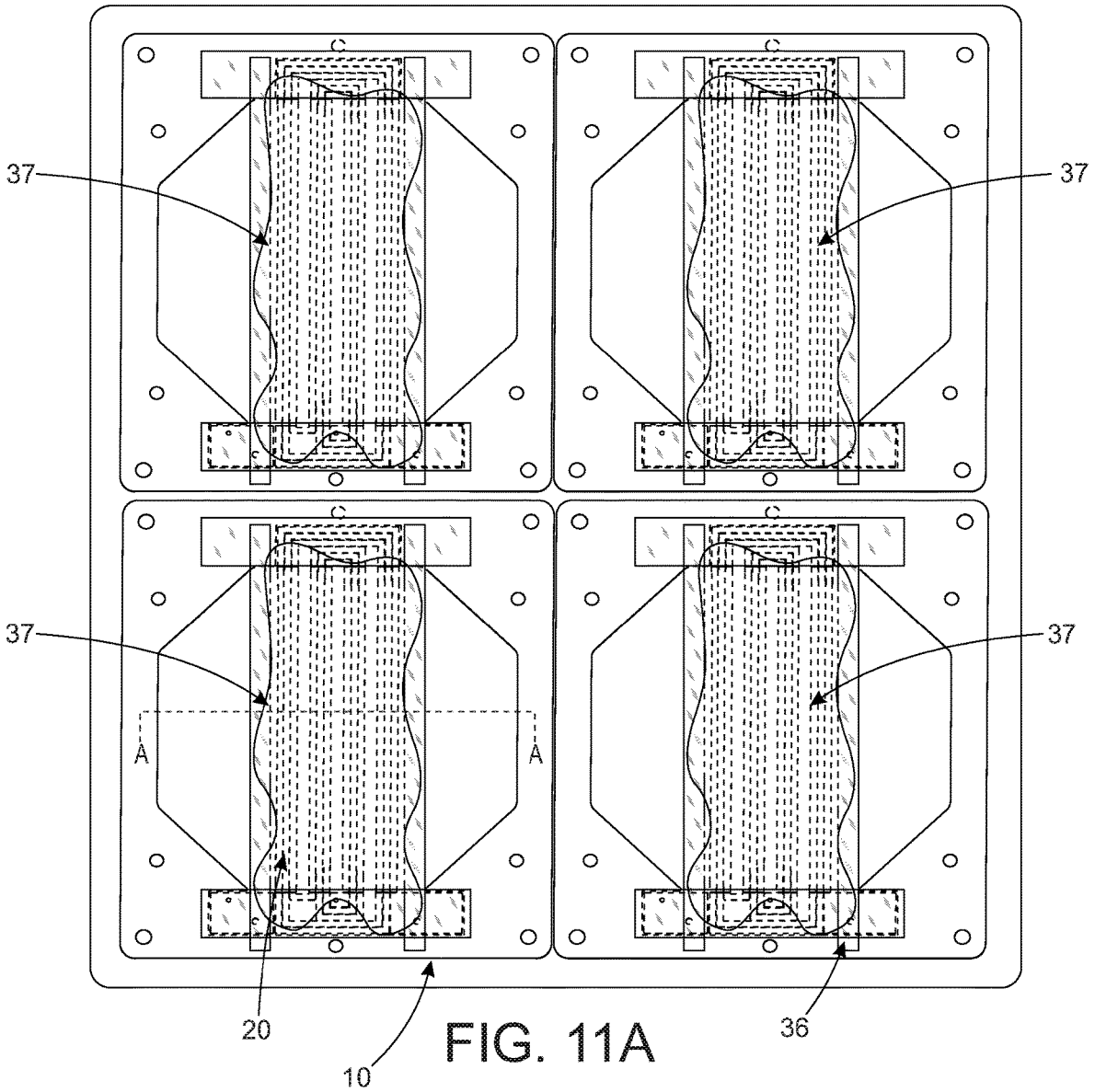
FIG. 11A is a top view of the plate of FIG. 10 having a maskant applied to portions of the image-side of the plate, in accordance with an embodiment of the present invention.
Figure 11B:
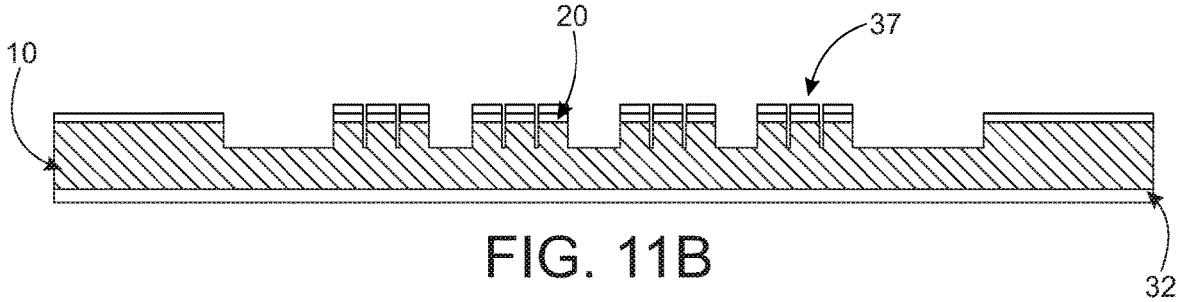
FIG. 11B is a general illustration of a cross-section taken through a portion of the plate of FIG. 11A.

FIG. 11A is a top view of the plate of FIG. 10 having a maskant applied to portions of the image-side of the plate, in accordance with an embodiment of the present invention. FIG. 11B is a cross-section of a portion of the plate of FIG. 11A. As shown, in the present embodiment, peelable maskant 36 is applied to top and bottom "inactive" coil areas of each image side 12 of Electrically Conducting Plate 10 in order to prevent those areas from being affected by subsequent processing steps. An inactive coil area is an area of the coil that is stationary not in the magnetic field of the coil structure, while an active coil area is an area that is configured to move, and is in the magnetic field of the coil structure. In the present embodiment, peelable maskant 36 is AC-850-CH-Toluene Tan by Quaker chemical. In alternative embodiments, other maskants may be used. FIG. 11 also generally illustrates backing material 34 having been removed from non-image side 14 of each Electrically Conducting Plate 10. FIG. 11 also generally illustrates a substance 37 deposited on a non-masked portion of the coil to remove photo resist 20 from that portion of the image-side of Electrically Conducting Plate 10.

Figure 12A:
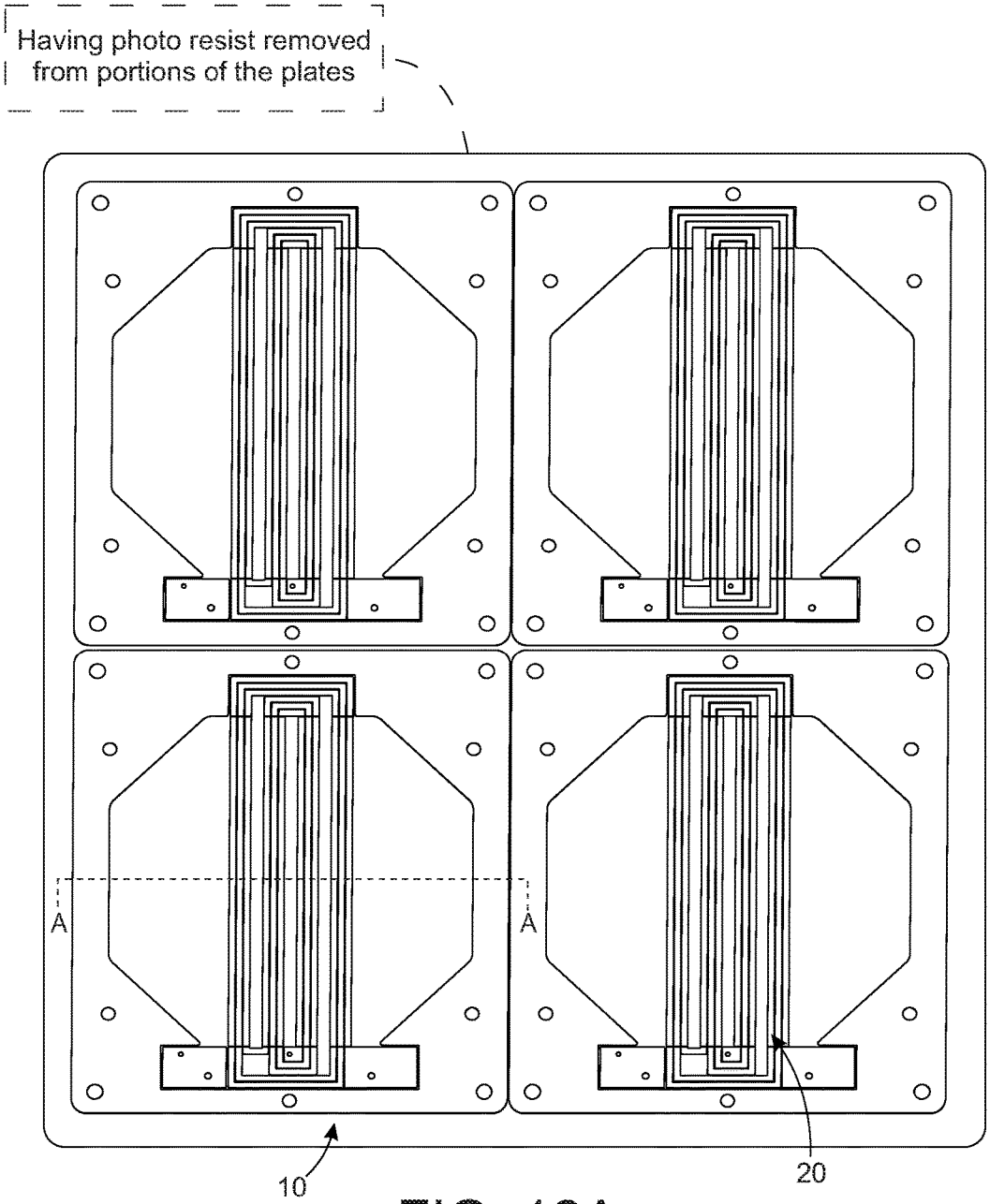
FIG. 12A is a top view of the plate of FIG. 11 having photo resist removed from the image-side of the plate, in accordance with an embodiment of the present invention.
Figure 12B:
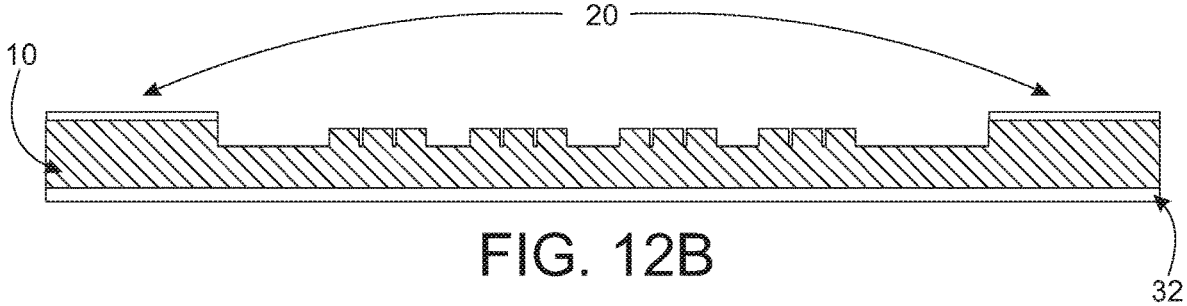
FIG. 12B is a general illustration of a cross-section taken through a portion of the plate of FIG. 12A.

FIG. 12A is top view of the plate of FIG. 11 having photo resist 20 removed from active coil areas of the image-sides of the plate, in accordance with an embodiment of the present invention. FIG. 12B is a cross-section of a portion of the plate of FIG. 12A. In the present embodiment, both the earlier-applied alkaline-resistant ink and photo resist are removed by applying Kodak brand 231 Negative Deletion Fluid to each image side 12 of each Electrically Conducting Plate 10 (generally illustrated in FIG. 11). In alternative embodiments, the ink and photo resist may be removed by applying other solutions such as CTP Deletion Pen for Metal Plates by Burnishine. FIG. 12 also generally illustrates maskant 36 having been removed from the top and bottom inactive coil areas of the image side 12 of Electrically Conducting Plate 10.

Figure 13:
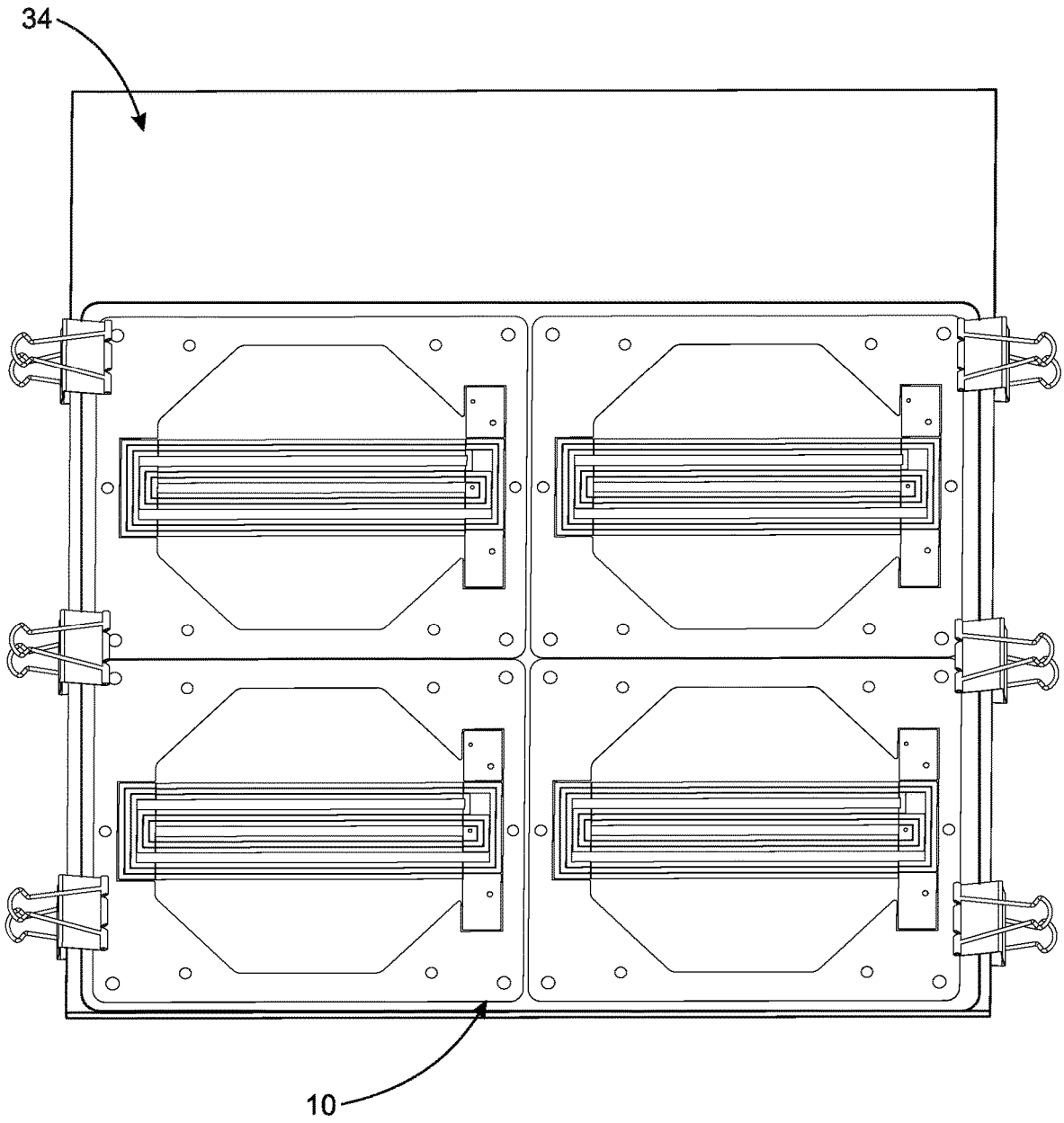
FIG. 13 is a top view of the plate of FIG. 12 having its non-imaged side secured to a backing, in accordance with an embodiment of the present invention.

FIG. 13 is a top view of the plate of FIG. 12 having its non-imaged side secured to a backing, in accordance with an embodiment of the present invention. In the present embodiment, each non-image side 14 of each Electrically Conducting Plate 10 is secured to a 0.125" thick sheet of PVC plastic as a backing material 34, leaving each image side 12 exposed. In alternative embodiments, the backing material 34 may be a material other than PVC or plastic, such as, for example stainless steel sheet.

Figure 14A:
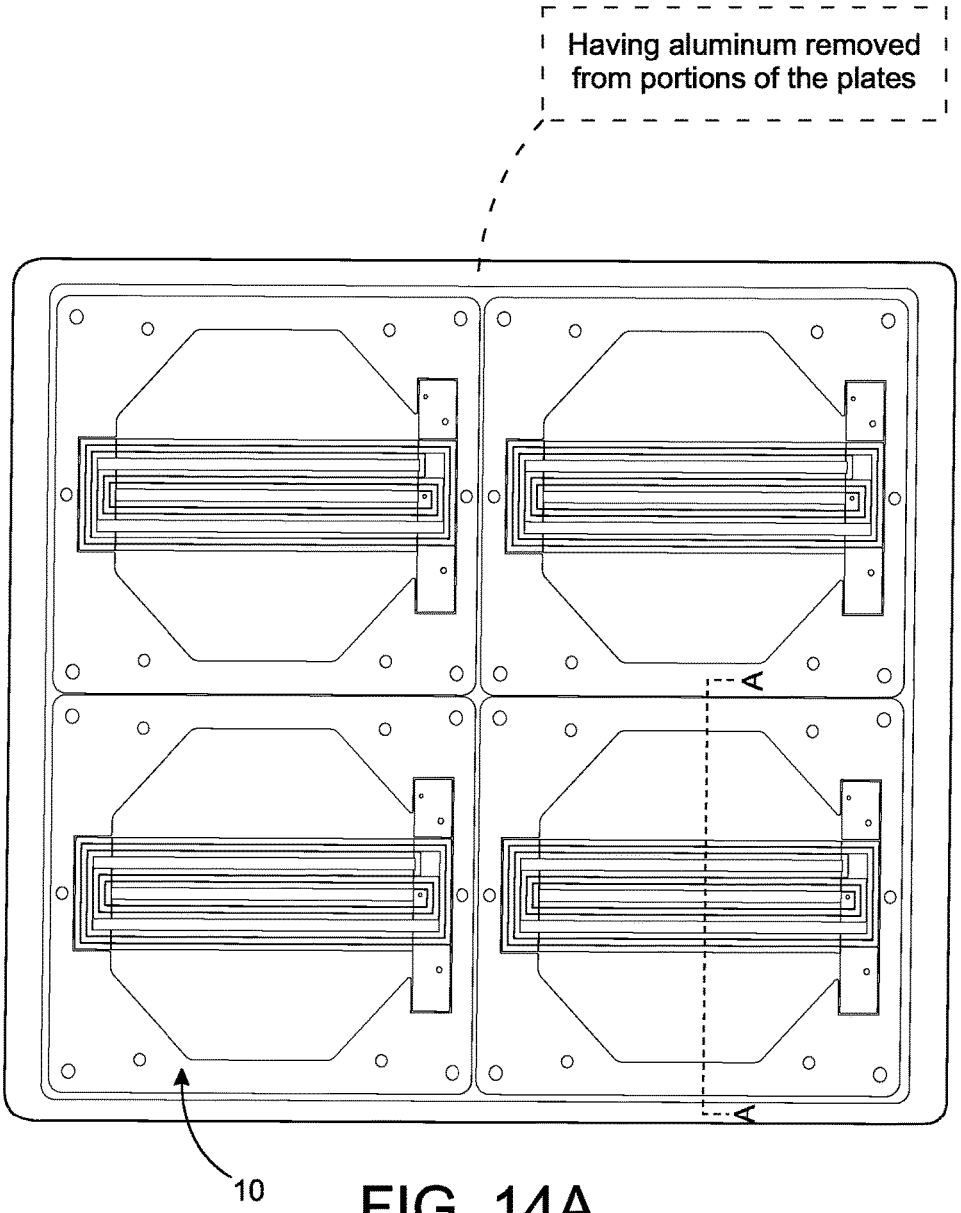
FIG. 14A is a top view of the plate of FIG. 13 having aluminum removed from portions of the plate, in accordance with an embodiment of the present invention.
Figure 14B:
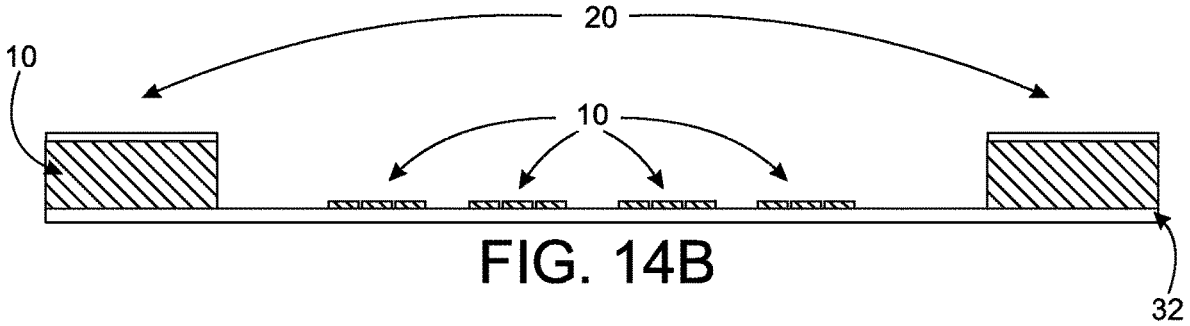
FIG. 14B is a general illustration of a cross-section taken through a portion of the plate of FIG. 14A.

FIG. 14A is a top view of the plate of FIG. 13 having aluminum removed from portions of the plate, in accordance with an embodiment of the present invention. FIG. 14B is a cross-section of a portion of the plate of 14A. In the present embodiment, the aluminum is removed by etching each Electrically Conducting Plate 10 in a solution of 3% by wt. of NaOH for approximately 3 to 3.5 hours, but in any case until the aluminum has been fully removed from the non-coil portion of each Electrically Conducting Plate 10, exposing coating 32 (which may hereinafter be referred to as a diaphragm). Each Electrically Conducting Plate 10 is rotated 180 degrees approximately every half hour to maintain uniformity in the etching process. It should be appreciated that in alternative embodiments, the duration of the etching, as well as the etching solution, may vary. FIG. 14 also generally illustrates backing material 34 having been removed from each non-image side 14 of Electrically Conducting Plate 10.

Figure 15:
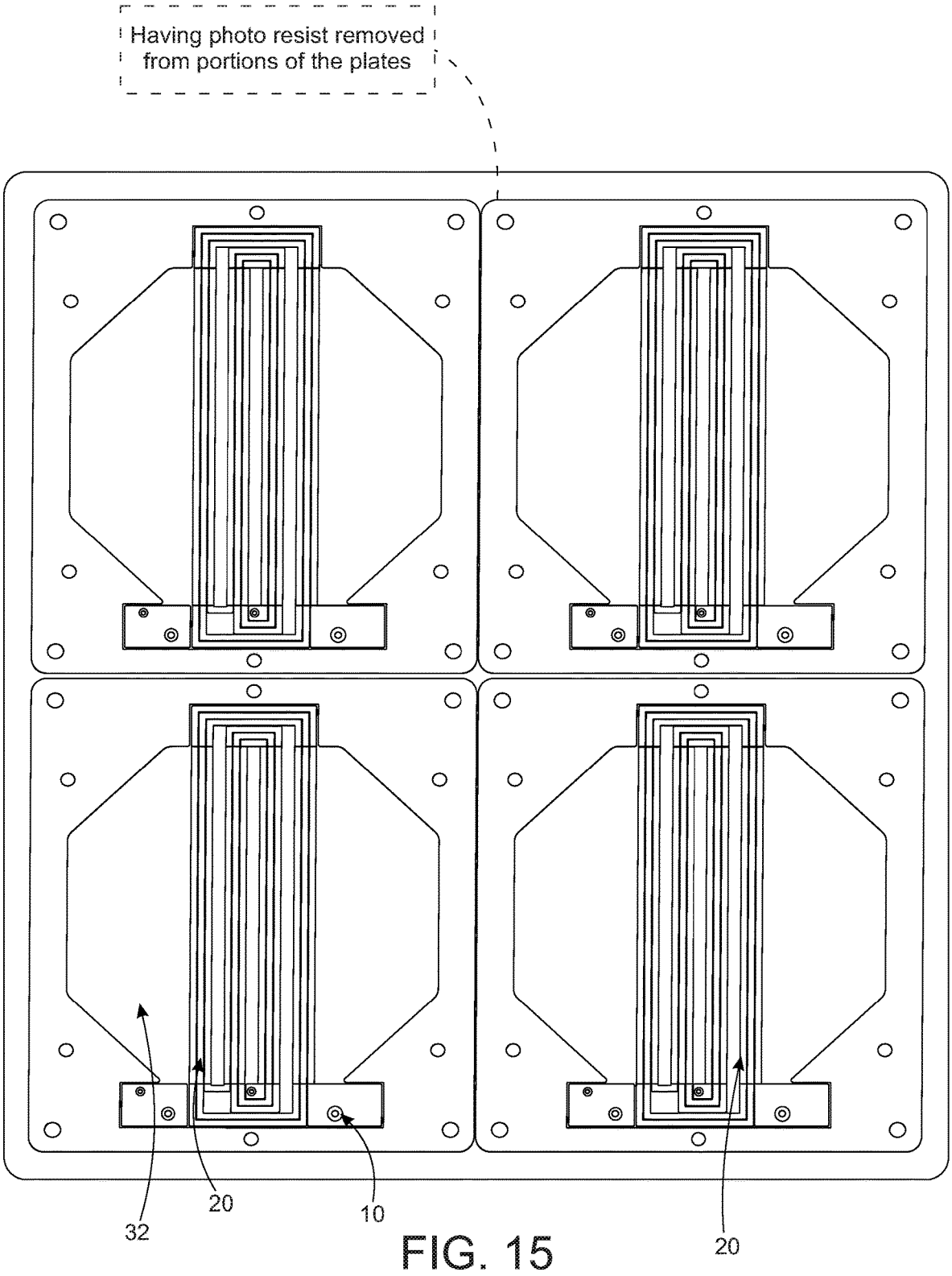
FIG. 15 is a top view of the plate of FIG. 14 having photo resist removed from the image-side of the plate, in accordance with an embodiment of the present invention.

FIG. 15 is a top view of the plate of FIG. 14 having photo resist removed from the image-sides of the plate, in accordance with an embodiment of the present invention. In the present embodiment, both earlier-applied alkaline-resistant ink and photo resist are removed from the coil contact areas located in the bottom inactive area of each image side 12 of each Electrically Conducting Plate 10 by applying Kodak brand 231 Negative Deletion Fluid to each image side 12 of each Electrically Conducting Plate 10. In alternative embodiments, the ink and photo resist may be removed by applying other solutions such as, for example CTP Deletion Pen for Metal Plates by Burnishine.

Figure 16:
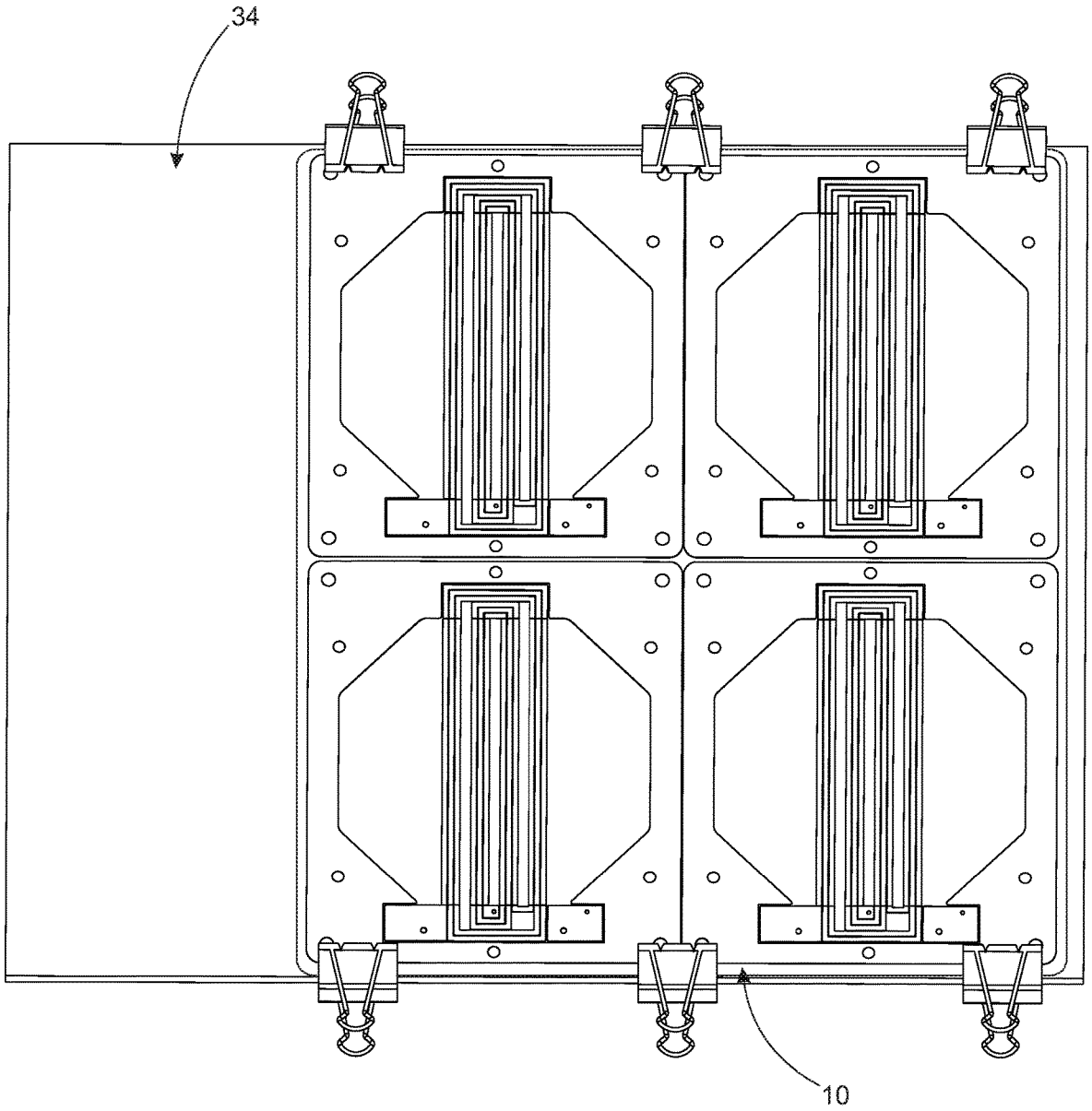
FIG. 16 is a top view of the plate of FIG. 15 having its non-imaged sides secured to a backing, in accordance with an embodiment of the present invention.

FIG. 16 is a top view of the plate of FIG. 15 having its non-imaged side secured to a backing, in accordance with an embodiment of the present invention. In the present embodiment, each non-image side 14 of each Electrically Conducting Plate 10 is secured to a 0.125" thick sheet of PVC plastic as a backing material 34, leaving each image side 12 exposed. In alternative embodiments, the backing material 34 may be a material other than PVC or plastic, such as, for example, stainless steel sheet. Before or after backing material 34 has been attached to each Electrically Conducting Plate 10, the resistance in the resulting coil of each Electrically Conducting Plate 10 is measured and logged using, for example, a Kelvin meter.

Figure 17A:
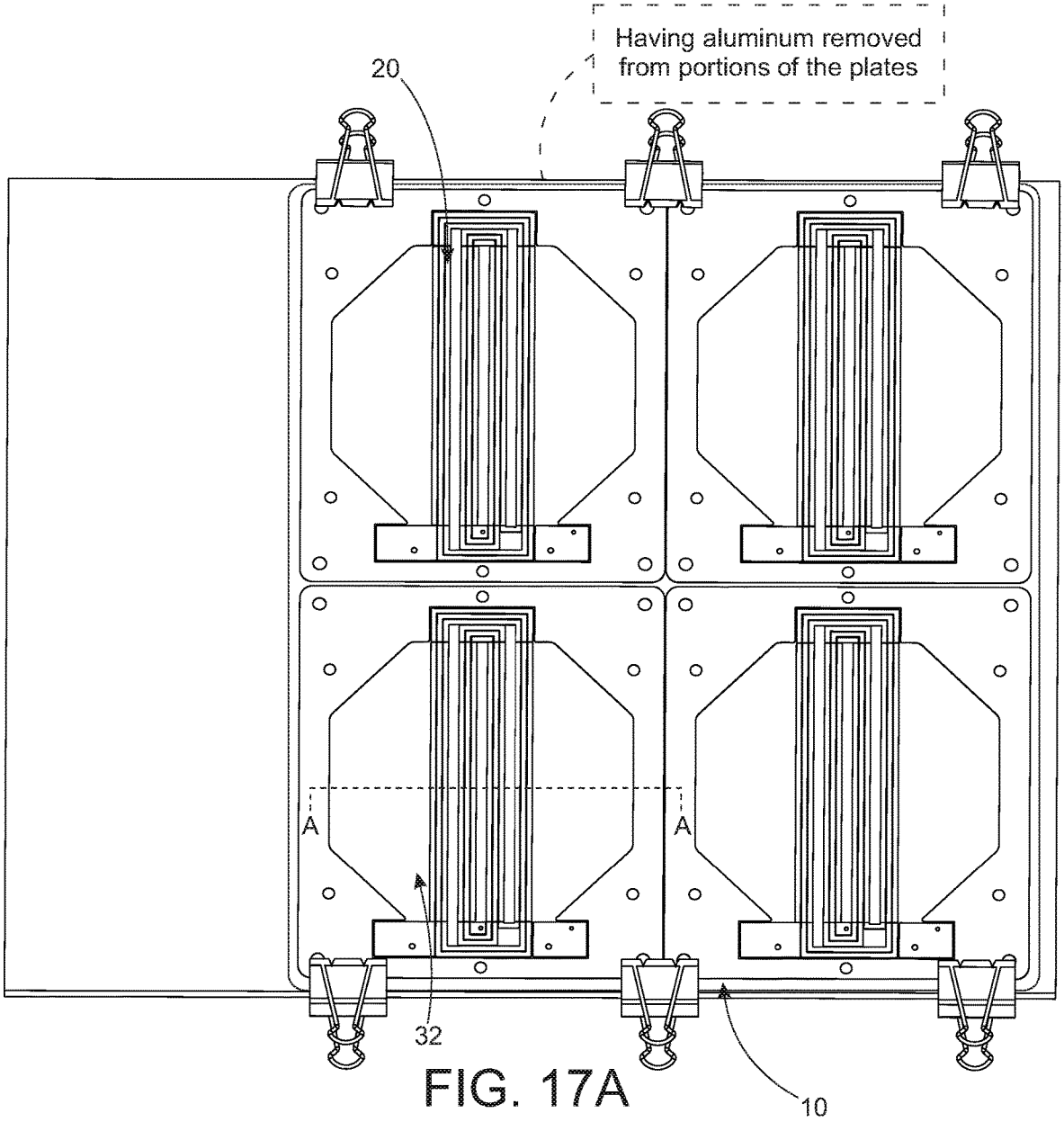
FIG. 17A is a top view of the plate of FIG. 16 having aluminum removed from portions of the plate, in accordance with an embodiment of the present invention.
Figure 17B:
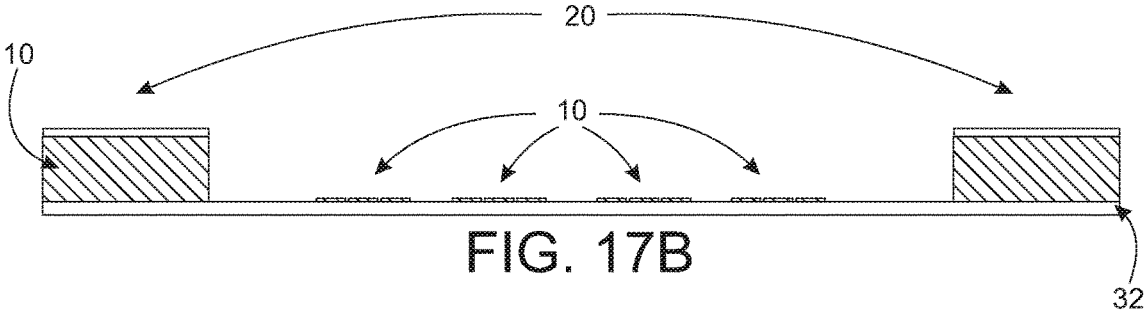
FIG. 17B is a general illustration of a cross-section taken through a portion of the plate of FIG. 17A.

FIG. 17A is a top view of the plate of FIG. 16 having aluminum removed from portions of the plate, in accordance with an embodiment of the present invention. FIG. 17B is a cross-section of the plate of FIG. 17A. In the present embodiment, the aluminum is removed by etching each Electrically Conducting Plate 10 in a bath of 3% by weight NaOH, for approximately 10 minutes. It should be appreciated that in alternative embodiments, the duration of the etching, as well as the etching solution, may vary. After the backing material 34 has been removed, the coil resistance of each coil of each Electrically Conducting Plate 10 is measured and compared to the target resistance value for each coil. If a coil has reached its target resistance value, processing for that coil is completed. If a coil has not reached its target resistance value, a target remaining etch time for that coil is determined. To do this, the etch rate for the coil is first determined by dividing the change in resistance in the coil by the amount of time for which the coil was etched (10 minutes if the coil was etched for 10 minutes as discussed above). Next, the target remaining etch time remaining for the coil is determined by subtracting the measured resistance of that coil from the target resistance value and dividing by the etch rate for that coil. Once the remaining etch time to reach a coil's target resistance, backing material 34 is re-attached to the non-image side 14 of the Electrically Conducting Plate 10, and the coil is etched for something less than the target time (to avoid over-etching). The coil resistance is then measured again, and this process is repeated until the target resistance is reached, at which time the coil is completed. In the present embodiment, the coil resistance is considered to be achieved when the measured coil resistance is within 1% of the target coil resistance.

Figure 18:
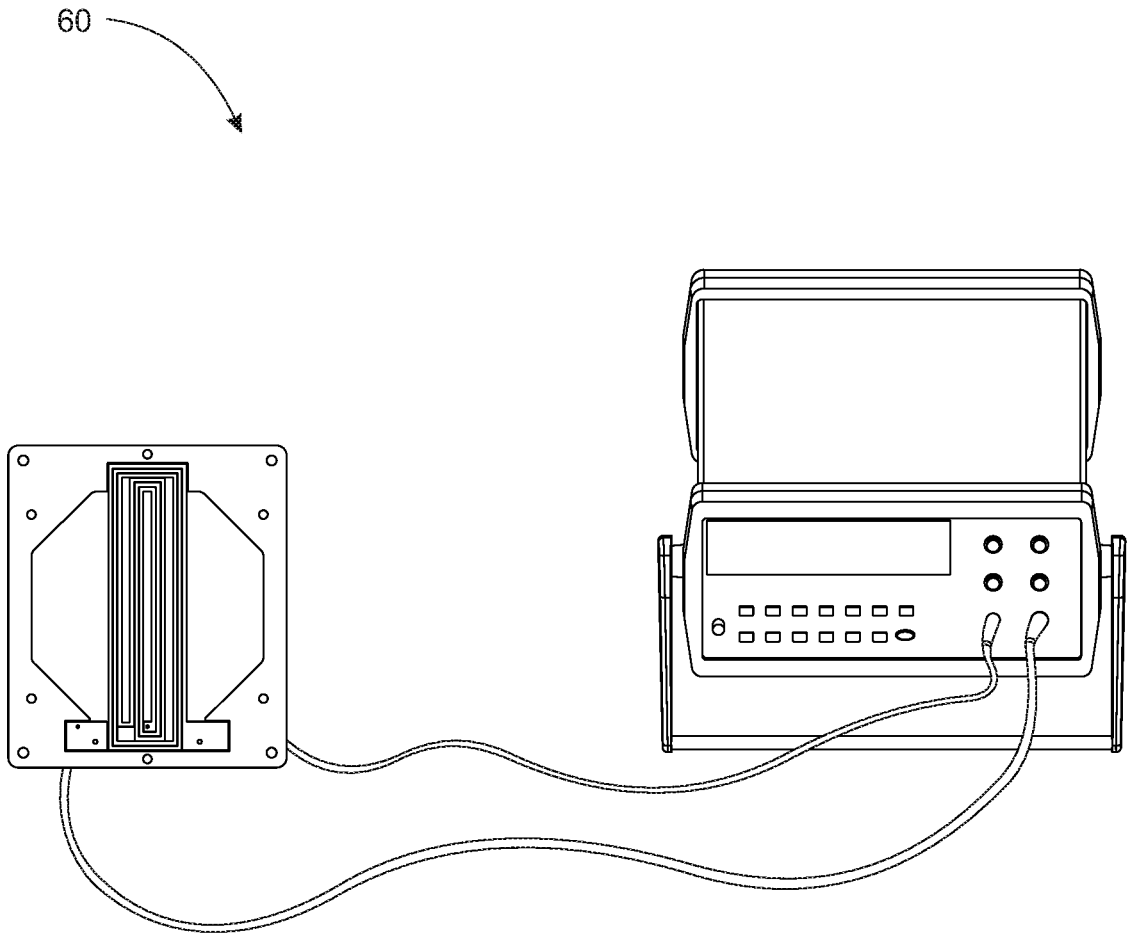
FIG. 18 is a front perspective view of a 3-lane coil produced in accordance with an embodiment of the present invention being tested with a multi-meter.

FIG. 18 is a front perspective view illustrating a 3-lane coil produced in accordance with an embodiment of the present invention. As shown, backing material 34 has been removed, and the coil is connected to a multi-meter for testing. The coil has been separated from the other coils previously present on the Electrically Conducting Plate 10. As shown, coil 60 has top and bottom inactive coil sections having a thickness of 0.15 to 0.2 mm. Coil 60 also includes active coil sections in which the active coil comprises 12 conducting lines. The thickness of the active coil sections has been precisely controlled in the above process to achieve thicknesses of less than that of the active coil sections and to achieve a precise resistance level.

Figure 19:
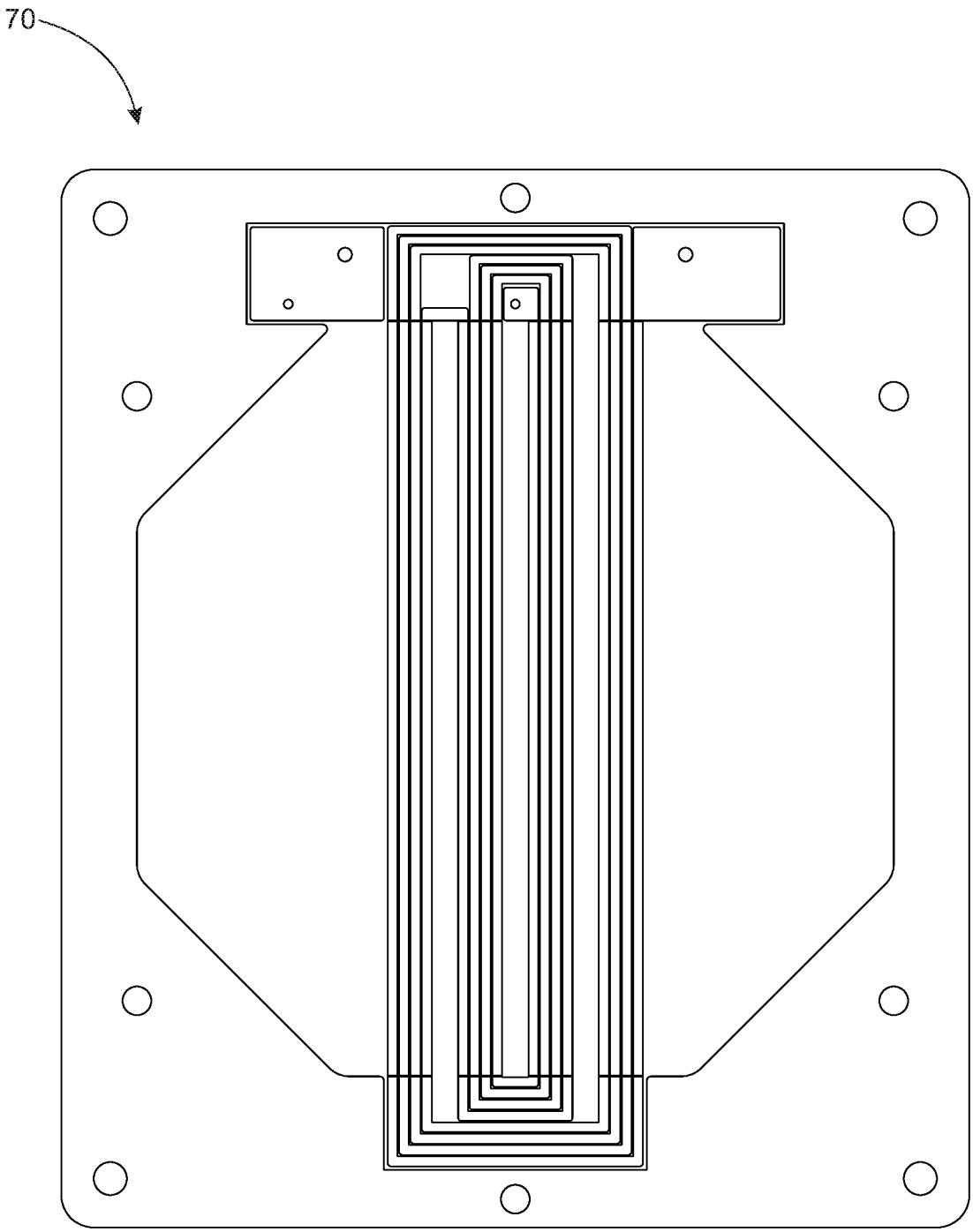
FIG. 19 is a top view of a 4-lane coil produced in accordance with an embodiment of the present invention.

FIG. 19 is a top view generally illustrating a 4-lane coil produced in accordance with an embodiment of the present invention. The coil has been separated from the other coils previously present on the Electrically Conducting Plate 10. As shown, coil 70 has top and bottom inactive coil sections having a thickness of 0.15 to 0.2 mm. Coil 70 also includes active coil sections in which the active coil comprises 16 conducting lines. The thickness of the active coil sections has been precisely controlled in the above process to achieve thicknesses of less than that of the active coil sections and to achieve a precise resistance level.

Figure 20:
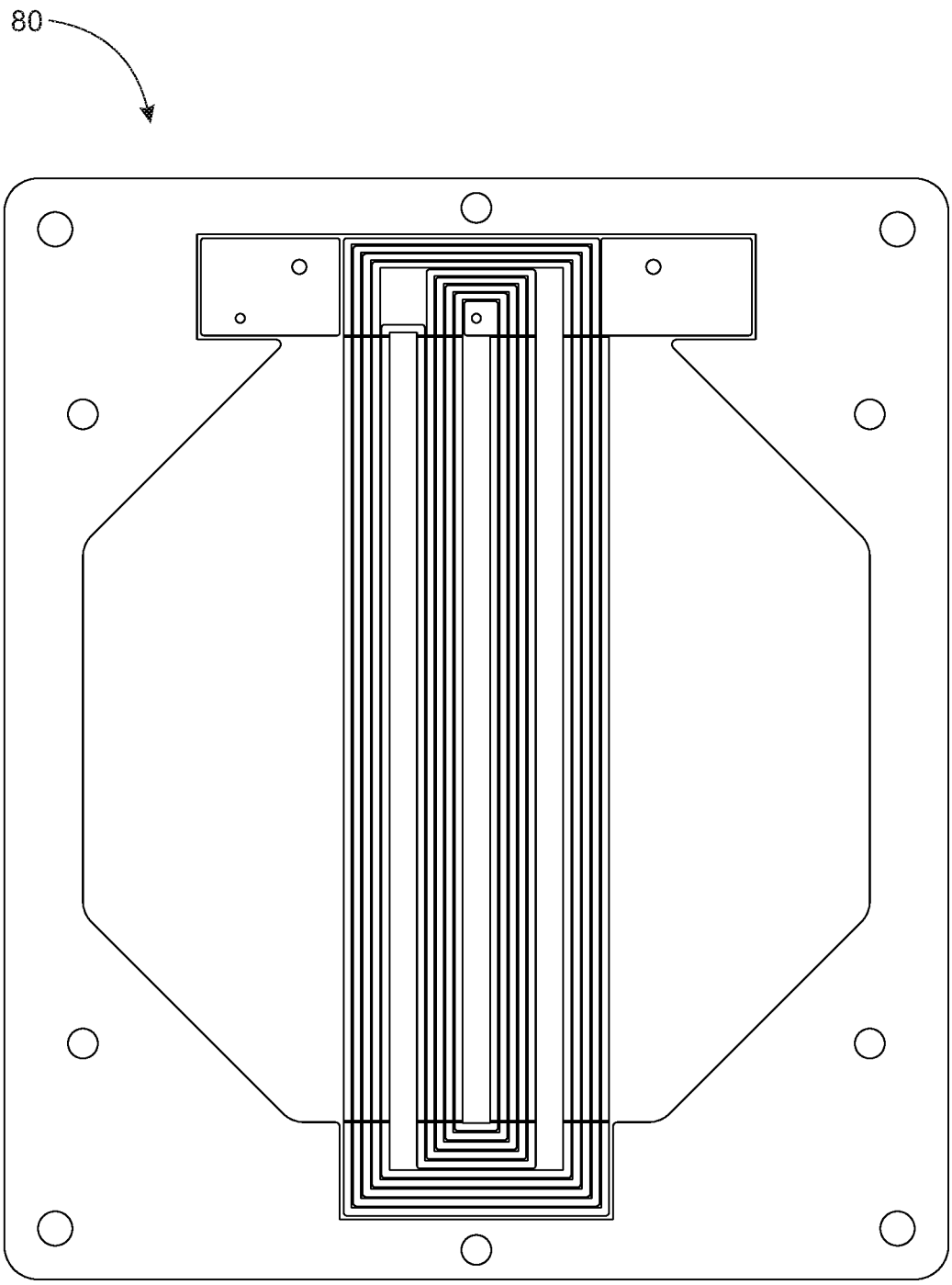
FIG. 20 is a top view of a 5-lane coil produced in accordance with an embodiment of the present invention.

FIG. 20 is a top view generally illustrating a 5-lane coil produced in accordance with an embodiment of the present invention. The coil has been separated from the other coils previously present on the Electrically Conducting Plate 10. As shown, coil 80 has top and bottom inactive coil sections having a thickness of 0.15 to 0.2 mm. Coil 80 also includes active coil sections in which the active coil comprises 20 conducting lines. The thickness of the active coil sections has been precisely controlled in the above process to achieve thicknesses of less than that of the active coil sections and to achieve a precise resistance level.

Figure 21:
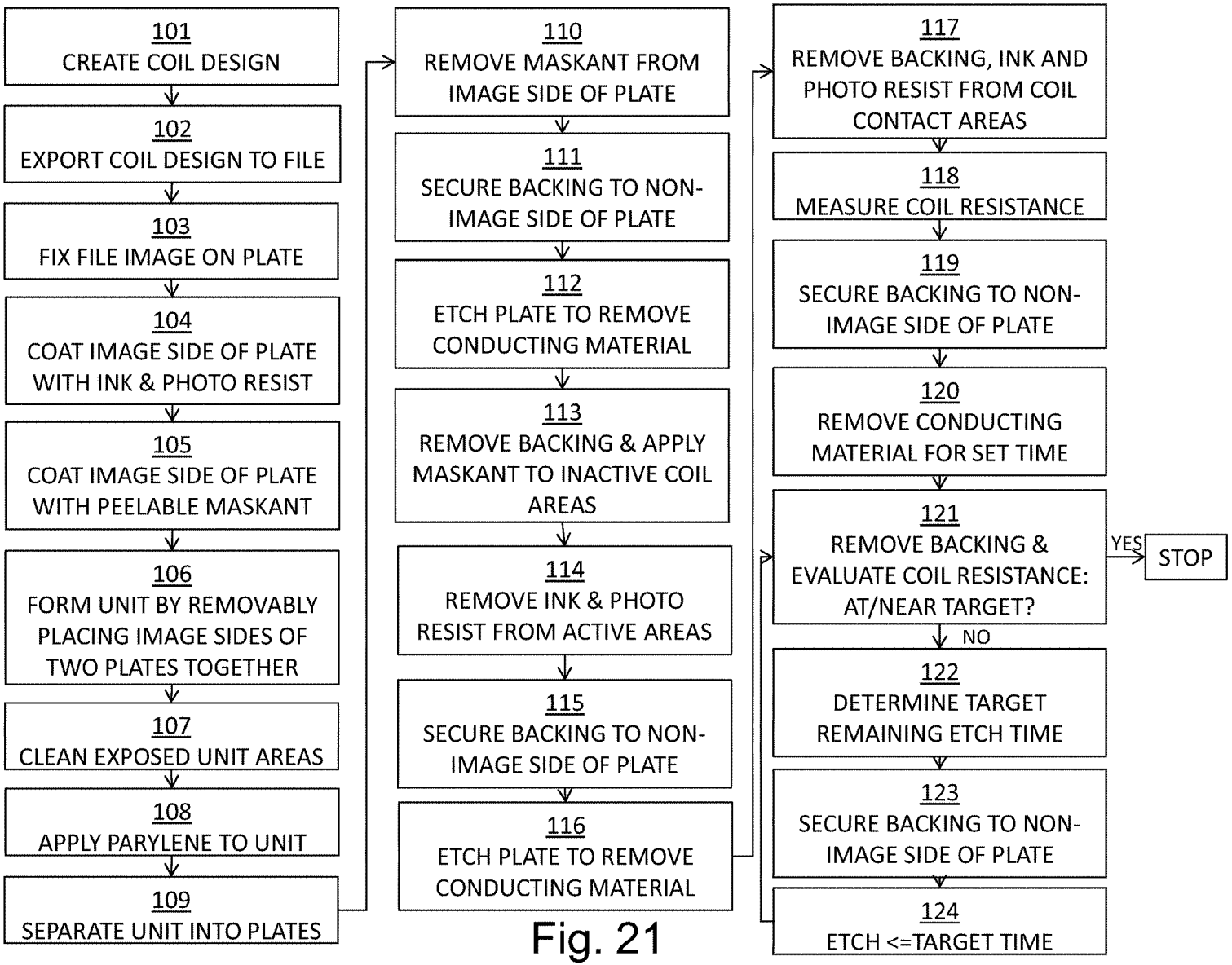
FIG. 21 is a flow chart generally illustrating a method for producing a coil in accordance with an embodiment of the present invention.

FIG. 21 is a flow chart generally illustrating a method for producing a coil in accordance with an embodiment of the present invention. In a first step 101 of the method 100, a coil design is created in a CAD or other software program. In a second step 102 of the method 100, the coil design is exported or saved to a standard format, such as, for example, a PDF format. In a third step 103 of the method 100, the coil design is fixed on an electrically conducting plate utilizing a computer-to-plate ("CTP") process, resulting in the plate having an image side and a non-image side. In a fourth step 104 of the method, the image side of the plate is coated with an alkaline-resistant ink and photo-resist. In a fifth step 105 of the method, the image side of the plate is further coated with a peelable maskant.

In a sixth step 106 of the method, at least two plates created with the above-referenced steps are combined into a unit having their maskant-coated image-sides pressed together and separated by a removable sheet, such as, for example, parchment paper. In a seventh step 107 of the method, the exposed, non-image sides of the resulting unit are cleaned to allow Parylene AF4 to adhere to them. In an eighth step 108 of the method, Parylene AF4 is applied to a pre-determined thickness to the exposed non-image sides of the resulting unit. In a ninth step 109 of the method, the unit is separated and the removable sheet is removed, exposing the maskant-coated image sides of the plates.

In a tenth step 110 of the method, the maskant is removed from the image sides of the plates. In an eleventh step 111 of the method, a 0.125" thick sheet of PVC plastic is secured to the non-image sides of the plates. In a twelfth step 112 of the method, conducting plate material is removed by placing the plates in an alkaline etch solution in a sonic-vibrated etch tank. In a thirteenth step 113 of the method, the plastic is removed, and maskant is applied to top and bottom "inactive" coil areas of the image sides of each of the plates in order to prevent those areas from being affected by subsequent processing steps. In a fourteenth step 114 of the method, exposed earlier-applied alkaline-resistant ink and photo resist are removed from the active coil lanes by applying Kodak brand 231 Negative Deletion Fluid to each of the plates.

In a fifteenth step 115 of the method, a 0.125" thick sheet of PVC plastic is secured to the non-image sides of the plates. In a sixteenth step 116 of the method, conducting plate material is removed by etching each plate in a solution until the conducting plate material has been fully removed from the non-coil portion of each plate. In a seventeenth step 117 of the method, the plastic is removed from the non-image sides of the plate, and the earlier-applied alkaline-resistant ink and photo resist are removed from the coil contact areas of the image side of each plate by applying negative deletion fluid to the plates. In an eighteenth step 118 of the method, the resistance of each coil formed on each plate is measured and logged.

In a nineteenth step 119 of the method, a 0.125" thick sheet of PVC plastic is secured to the non-image sides of the plates. In a twentieth step 120 of the method, aluminum is removed by etching each plate for a predetermined period of time. In a twenty-first step 121 of the method, the plastic is removed from the non-image sides of the plates, and the coil resistance of each coil of each plate is measured and compared to a target resistance value. If a coil has reached its target resistance value, the method is completed for that plate/coil. If the coil has not reached its target value, the method continues with step 122, in which a target remaining etch time for that coil is determined. The target remaining etch time is determined by first determining the rate at which coil in question etched (the etch rate—based on the resistance of the coil pre-etch, the resistance of the coil post-etch, and the elapsed time, resulting in an etch rate of ohm/time). Next, the target remaining etch time for the coil is determined by subtracting the measured resistance of that coil from the target resistance value and dividing by the etch rate for that coil. In step 123, the plastic is re-attached to the non-image side of the plate. In step 124, the plate is etched for something less than the target etch time (to avoid over-etching). The method then returns to step 121, and the process continues iteratively until the coil resistance reaches its target value.

FIG. 22 is a spreadsheet generally illustrating performance enhancements and benefits of coils of a three-lane coil embodiment of the present invention relative to other coils not made according to the present invention.

FIG. 23 is a spreadsheet generally illustrating performance enhancements and benefits of coils of a four-lane coil embodiment of the present invention relative to other coils not made according to the present invention.

FIG. 24 is a spreadsheet generally illustrating performance enhancements and benefits of coils of a five-lane coil embodiment of the present invention relative to other coils not made according to the present invention.

It should be appreciated that although the present invention involves the processing of multiple plates at once, in an alternative embodiment, a single plate could be processed at a time. In that case a "sandwich" of two plates between which a paper or barrier is present would not be utilized. Rather, the steps of forming the sandwich and separating the plates from the sandwich would be omitted. It should also be appreciated that the present invention provides for very precise control of the thickness of the diaphragm portion of the coil-diaphragm assembly (by precisely controlling at deposition the thickness of the applied coating 32 to minimize mass while maintaining sufficient stiffness to support the coil structure and serve as a diaphragm in an audio speaker environment). It should also be appreciated that the present invention provides for very precise control of the geometry of the conducting coil portion of the coil-diaphragm assembly, including, for example, the precise shape of the coil, the precise dimensions (thickness, width, and length) of the coil, and the precise spacing between the coil lines as a result of the photolithography and etching processes. This allows for extremely precise control of the impedance and frequency response of the resulting coil-diaphragm assembly, while minimizing the mass of the assembly.

Although the preferred embodiments of the invention have been illustrated and described, it will be readily apparent to those skilled in the art that various modifications may be made therein without departing from the spirit of the invention or from the scope of the appended claims.

The invention claimed is:

1. A method for producing a coil-diaphragm assembly, the method comprising the steps of:

providing a first metallic sheet having an image side and a non-image side;

fixing a coil image on the image side of the first metallic sheet;

applying a conformal coating to the non-image side of the first metallic sheet; and, removing material from the image side of the first metallic sheet to expose portions of the coating from the image side of the metallic sheet.

2. An integrated coil-diaphragm assembly comprising:

a planar conformal coating diaphragm having a first planar surface and an opposing second planar surface;

a planar electrically conducting planar path with an inner and outer surface shaped into multiple turns, the turns comprising lanes of the electrically conducting planar path, wherein the inner surface of the electrically conducting planar path is directly coupled to the first planar surface of the conformal coating diaphragm without any intermediating substance between the inner surface of the electrically conducting planer path and the first planar surface of the conformal coating diaphragm.

* * * * *